US007248730B2

(12) United States Patent
Matsui et al.

(10) Patent No.: US 7,248,730 B2
(45) **Date of Patent: *Jul. 24, 2007**

(54) CERTIFIED PAPER DISCRIMINATING APPARATUS

(75) Inventors: Toru Matsui, Osaka (JP); Benedikt Ahlers, Berlin (DE); Anett Bailleu, Berlin (DE); Roland Gutmann, Falkensee (DE); Frank Kappe, Rheda-Wiedenbruck (DE)

(73) Assignee: Bundesdruckerei GmbH, Berlin (DE)

( * ) Notice: Subject to any disclaimer, the term of this patent is extended or adjusted under 35 U.S.C. 154(b) by 588 days.

This patent is subject to a terminal disclaimer.

(21) Appl. No.: 10/363,016

(22) PCT Filed: Aug. 29, 2001

(86) PCT No.: PCT/EP01/09936

§ 371 (c)(1),
(2), (4) Date: Jul. 30, 2003

(87) PCT Pub. No.: WO02/19278

PCT Pub. Date: Mar. 7, 2002

(65) Prior Publication Data

US 2004/0035932 A1 Feb. 26, 2004

(30) Foreign Application Priority Data

Aug. 31, 2000 (JP) ..... 2000-263764
Aug. 31, 2000 (JP) ..... 2000-263765

(51) Int. Cl.
*G00K 9/00* (2006.01)

(52) U.S. Cl. ..... 382/135; 356/71; 250/200

(58) Field of Classification Search ..... 382/112, 382/135; 283/82; 235/454, 491; 250/271, 250/458

See application file for complete search history.

(56) References Cited

U.S. PATENT DOCUMENTS

| | | | | | |
|---|---|---|---|---|---|
| 4,587,434 | A * | 5/1986 | Roes et al. | ..... | 250/556 |
| 4,630,814 | A * | 12/1986 | Kawakubo et al. | ..... | 271/272 |
| 5,502,304 | A * | 3/1996 | Berson et al. | ..... | 250/271 |
| 5,523,710 | A * | 6/1996 | Miyake et al. | ..... | 327/198 |
| 5,640,463 | A * | 6/1997 | Csulits | ..... | 382/135 |
| 5,646,479 | A * | 7/1997 | Troxell | ..... | 313/495 |
| 5,719,948 | A | 2/1998 | Liang | ..... | 382/112 |
| 5,886,342 | A * | 3/1999 | Matsui | ..... | 250/208.1 |

(Continued)

FOREIGN PATENT DOCUMENTS

DE 197 08 543 3/1997

*Primary Examiner*—Joseph Mancuso
*Assistant Examiner*—Andrae Allison
(74) *Attorney, Agent, or Firm*—Darby & Darby

(57) ABSTRACT

An apparatus configured to discriminate the genuineness of a certified paper by exposing the paper to a light source and transporting the paper through an environment of an alternating-current electromagnetic field. Light detectors detect the light reflected from the paper and the light emitted by a fluorescent ink on the paper and output a waveform corresponding to the intensity of the detected light, reflected light, and the detected emitted light as the paper is scanned. The resulting waveforms are used to discriminate the genuineness of the paper. The fluorescent light and reflected light can be optically split and directed to separate detecting devices. Furthermore, the alternating-current electromagnetic field can be controlled by a voltage controller and configured to be driven only when the sensor detects light from the fluorescent ink.

22 Claims, 15 Drawing Sheets

U.S. PATENT DOCUMENTS 5,918,960 A * 7/1999 Hopwood et al. ..... 356/71
5,960,103 A * 9/1999 Graves et al. ..... 382/135
6,050,387 A * 4/2000 Iwaki ..... 194/207
6,373,965 B1 * 4/2002 Liang ..... 382/112
6,459,276 B1 * 10/2002 Matthews et al. ..... 324/545
6,459,806 B1 * 10/2002 Raterman et al. ..... 382/135
6,473,165 B1 * 10/2002 Coombs et al. ..... 356/71
6,888,590 B1 * 5/2005 Nishioka et al. ..... 349/57
6,918,482 B2 * 7/2005 Thierauf ..... 194/207
2002/0033316 A1 * 3/2002 Kappe et al. ..... 194/206

* cited by examiner

CERTIFIED PAPER DISCRIMINATING APPARATUS

This application is the U.S. National Phase of International Application Ser. No. PCT/EP01/09936, filed Aug. 29, 2001 and published in English on Mar. 7, 2002 under WIPO Publication No. WO 02/19278. This application claims priority under 35 U.S.C. § 119(b) from Japanese Patent Applications Nos. 2000-263764 and 2000-263765, both filed Aug. 31, 2000, the entire disclosure of which is incorporated by reference herein.

BACKGROUND OF THE INVENTION AND RELATED ART STATEMENT

This invention relates to a discriminating apparatus capable of discriminating genuineness of various certified papers including, for example, bank notes, securities such as stocks and various other certified documents such as slips.

There have been conventionally known discriminating apparatuses for discriminating genuineness of bank notes, securities or like certified papers. Such discriminating apparatuses discriminate genuineness of certified paper by photoelectrically scanning characters, figures, symbols, or (hereinafter referred to collectively as "patterns") printed in specified positions of the paper, and comparing a scanned pattern with a pre-stored pattern of the genuine certified paper.

However, improved forging technology has made it difficult to discriminate forged certified paper from genuine certified paper only based on usual printed patterns. German Unexamined Patent Publication DE 197 085 43 A1 discloses printing of bank notes with a luminescent ink containing electroluminescent material which emits a light upon application of ultraviolet rays or an alternating voltage. The use of such an electroluminescent ink makes the certified paper luminous upon projection of ultraviolet rays or upon being placed in an alternating-current electromagnetic field and accordingly enables discrimination of genuineness of a certified paper by detecting the presence or absence of the luminous light even if the printed patterns made on the genuine and counterfeit certified papers by usual printing coincides with that of the genuine.

In addition, a system of detecting a light emitted from the certified paper resulting from a corona discharge caused by placing the certified paper in an environment of a high-voltage alternating-current electromagnetic field and discriminating genuineness by comparing a pattern of the detected light emission with a light emission pattern of a genuine certified paper may be added to the above system of optically scanning the printed patterns.

A discriminating apparatus adopting such a composite system can discriminate genuineness not only based on the light emission from the certified paper caused by the corona discharge, but also based on the printed patterns, i.e. the certified paper is doubly checked. Therefore, such a discriminating apparatus is expected to make a highly accurate genuineness discrimination.

In the above composite system, the certified paper is transported to an environment of a high-voltage alternating-current electromagnetic field set in advance, and a light emitted from and a light reflected by a portion of the certified paper having reached a light collecting spot are detected by a light detecting element. However, with such an arrangement, the certified paper is exposed to the environment of the high-voltage alternating-current electromagnetic field while passing a sensor for the discrimination, which presents a problem of deteriorating the certified paper.

In view of the above problem, an object of the present invention is to provide a certified paper discriminating apparatus which adopts a composite discriminating system of discriminating genuineness by detecting a reflected light from and a light emitted from a certified paper being discriminated and is capable of effectively suppressing deterioration of the certified paper.

The present invention is directed to a certified paper discriminating apparatus for discriminating genuineness of a certified paper printed using a fluorescent ink which emits a light upon being placed in an environment of an alternating-current electromagnetic field and emits a fluorescent light upon being illuminated by a light having a specified wavelength, comprising an alternating voltage applying means for applying an alternating voltage to specified electrodes opposed to each other for generating the environment of the alternating-current electromagnetic field; a light detecting means for detecting a light from a light collecting spot of the certified paper being transported in the environment of the alternating-current electromagnetic field; a light emitting means for emitting the light having the specified wavelength toward the light collecting spot; an optically splitting means for splitting the light detected by the light detecting means into a light from the fluorescent ink and an other light; an alternating voltage control means for controlling driving of the alternating voltage applying means; and a genuineness discriminating means for discriminating the genuineness of the certified paper based on an output value of the light detecting means, wherein the alternating voltage control means drives the alternating voltage applying means only when the light detecting means detects the light from the fluorescent ink.

With the apparatus thus constructed, the light detecting means detects the reflected light from the certified paper having its wavelength distribution optically split by transporting the certified paper toward the light collecting spot with the light emitted toward the light collecting spot from the light emitting means. The optically splitting means has such a wavelength selecting property that the light emitting means detects the light from the fluorescent ink based on a difference in wavelength distribution. The alternating voltage control means outputs a control signal to the alternating voltage applying means only upon confirming the light from the fluorescent ink based on a detection signal from the light detecting means, thereby setting the environment of the alternating-current electromagnetic field at the light collecting spot.

Accordingly, the fluorescent ink on the certified paper located at the light collecting spot emits a light, which is detected by the light detecting means. The genuineness discriminating means discriminates the genuineness of the certified paper based on the output value of the light detecting means.

Since the alternating voltage is applied to the certified paper only when the fluorescent ink is located at the light collecting spot, a period during which the certified paper is exposed to the high-voltage alternating-current electromagnetic field is shortened as compared to a case where it is transported with the environment of the high-voltage alternating-current electromagnetic field set at the light collecting spot P from the beginning on. This minimizes an influence on the quality of the certified paper caused by a long exposure time, thereby avoiding undesirable situations where deterioration of the certified paper is advanced by the genuineness discrimination and a lifetime of an insulating element is shortened.

Preferably, the genuineness discriminating means discriminates genuineness based on the output values of the light detecting means representing the light emitted from the light emitting means and reflected at the light connecting spot and the light emitted from the fluorescent ink.

With this construction, the fluorescent ink on the certified paper emits a light at the light collecting spot set in the environment of the alternating-current electromagnetic field, and this light is detected by the light detecting means, whose corresponding output value is sent to the genuineness discriminating means. Further, the light (fluorescent light) emitted from the light emitting means and reflected at the light collecting means is also detected by the light detecting means, whose corresponding output value is sent to the genuineness discriminating means. Since the genuineness discriminating means discriminates the genuineness of the certified paper based on these two output values, precision of the genuineness discrimination can be improved.

DETAILED DESCRIPTION OF THE PREFERRED EMBODIMENTS OF THE INVENTION

FIGS. 1 and 2 are perspective views showing one embodiment of a certified paper discriminating apparatus according to the present invention, wherein FIG. 1 shows a state where a casing lid is closed and FIG. 2 shows a state where the casing lid is open. FIG. 3 is an exploded perspective view showing one embodiment of an apparatus main body provided in a casing, and FIG. 4 is a perspective view showing the assembled apparatus main body. FIG. 5 is a section along A-A of FIG. 4. It should be noted that, in FIGS. 1 to 4, directions of X-X, Y-Y, −X, +X, −Y and +Y are referred to as widthwise, forward and backward, leftward, rightward, forward and backward directions.

The certified paper discriminating apparatus 1 according to this embodiment discriminates genuineness of bank notes (certified papers) on which characters, figures or symbols are printed using both an electroluminescent ink which emits a light upon being placed in an environment of an alternating-current electromagnetic field and a usual printing ink. The discriminating apparatus 1 is internally provided with a first detecting construction 71 and a second detecting construction 72 to be described in detail later in order to make the above discrimination. The first detecting construction 71 detects electroluminescent light emission in the environment of an alternating-current electromagnetic field, whereas the second detecting construction 72 detects a reflected light from the usual ink.

As shown in FIGURES, an apparatus main body 2 and a control unit 8 are contained in a box-shaped casing 9 in the discriminating apparatus 1. The casing 9 is comprised of a rectangular parallelepipedic casing main body 91 and a lid 92 provided atop the casing main body 91.

A pair of brackets 93 extending in forward and backward directions are provided at the opposite sides of the upper surface of the casing main body 91 with respect to its widthwise direction. The lid 92 is made displaceable between a closing position shown in FIG. 1 where it is placed on the casing main body 91 and an exposing position shown in FIG. 2 where it stands at the rear end of the casing main body 91 by rotatably supported about a horizontal axis 94 while having its rear end tightly held between the pair of brackets 93.

With the lid 92 in its closing position, a note passing slit 95 is defined between the upper surface of the casing main body 91 and the lower surface of the lid 92 as shown in FIG. 1. When a bank note M is inserted into the note passing slit 95 from the front side of the casing 9, a specified sensor (comprised of a LED 55 and a light detecting element 56 facing the LED 55 as shown in FIG. 2) detects it and a driving mechanism is driven in accordance with a drive signal from the control unit 8 sent in response to a detection signal of the sensor to pull the bank note M into the note passing slit 95. Whether or not the inserted bank note M is genuine is discriminated by a discriminating mechanism first and second detecting constructions 71 and 72 contained in the apparatus main body 2 as described later.

As shown in FIGS. 2 and 5, the LED 55 is provided at the widthwise center of the front part of a bottom plate 92*a* of the lid 92, whereas the light detecting element 56 is provided at a position of a top plate 950 of the casing main body 91 facing the LED 55. With the lid 92 closed, an optical path of the LED 55 is blocked to interrupt the light detection of the light detecting element 56 by the bank note M, thereby detecting the insertion of the bank note M into the note passing slit 95.

A plurality of guide projections 95*a* elongated in forward and backward directions are formed on the upper surface of the casing main body 91 of the note passing slit 95, and elongated grooves 95 are formed between adjacent guide projections 95*a*. These guide projections 95*a* and the elongated grooves 95*b* form the top plate 950 of the casing main body 91 as a transport path for the bank note M.

The plurality of elongated grooves 95*b* are formed with notches in their front and rear positions, through which notches top parts of transport rollers 95*c* project. On the other hand, a pair of front and rear auxiliary rollers 95*d* facing the transport rollers 95*c* are provided on the rear surface of the lid 92. The bank note M inserted into the note passing slit 95 passes through the note passing slit 95 by the rotation of the transport rollers 95*c* while being tightly held between the transport rollers 95*c* and the auxiliary rollers 95*d* and is discharged to the outside through the rear end of the note passing slit 95.

Further, a power switch 96 is provided at the front side of the right side surface of the casing main body 91, and a display lamp assembly 98 is provided at a front position of the top of the lid 92. The display lamp assembly 98 is comprised of a ready lamp 98*a* for displaying whether the discriminating apparatus 1 is in an operable state, a success lamp 98*b* for displaying whether a discrimination result on genuineness of the bank note M is a success, and a failure lamp 98*c* for displaying whether the discrimination result on genuineness of the bank note M is a failure. The ready lamp 98*a* is turned on by turning the power switch 96 on, thereby showing that the apparatus main body 2 is in a state capable of discriminating. While the apparatus main body 2 is undergoing a discrimination process, this ready lamp 98*a* is turned off, thereby letting an operator know that he should not insert a next bank note until the ready lamp 98*a* is turned on again.

As shown in FIGS. 3 to 5, the apparatus main body 2 includes a sensor unit 20 (mainly comprised of the first and second detecting constructions 71, 72) constructed by integrally making a light detecting element and a light emitting element to be described later, optical members, printed circuit boards into a module; a roller member 3 provided in the casing main body 91; and a sensor casing 4 which is so provided in the lid 92 as to face the outer circumferential surface of the roller member 3 and on which various sensors, circuit boards, etc. are mounted.

The roller member 3 serves as one of electrodes to which an alternating voltage from an alternating-current power supply 30 (see FIG. 5) is applied. A light collecting spot P is defined between the top of the roller member 3 and a glass substrate 6 to be described later, and a light from a portion of the bank note M located at the light collecting spot P is incident on a light detecting device 51 to be described later with the bank note M supplied between the roller member 3 and the glass substrate 6. Such a roller member 3 is comprised of a metallic center axis 31 extending in widthwise direction and rotatably supported about its longitudinal axis on specified bearings provided in the casing main body 91, a metallic disk 32 concentrically and integrally fixed to the center axis 31, and an insulating ring 33 made of a material having a high permittivity such as barium titanate ($BaTiO_3$) and concentrically pressingly fitted on the metallic disk 32.

A lead plate 35 is adopted as the other electrode to which the alternative voltage is applied. This lead plate 35 is comprised of a flat lead plate main body 35*a* and a bent piece 35*b* formed by bending a front end portion of the lead plate main body 35*a* downward. The bent piece 35*b* and an ITO film 66 (an electrically conductive film formed on the bottom surface of the glass substrate 6 by deposition) are electrically connected by an unillustrated conductive paste. The alternating voltage from the alternating-current power supply 30 is applied to the bank note M inserted into the note passing slit 95 via the roller member 3 and the ITO film 66 to create an alternating-current electromagnetic field in the note passing slit 95.

On the other hand, a rectangular roller fitting window 91*a* (see FIG. 2) is formed in a center position of the top plate 950 of the casing main body 91, and the metallic ring 34 of the roller member 3 projects to the outside through this roller fitting window 91*a*. The roller member 3 is biased upward by a biasing force from an unillustrated biasing means, whereby the top thereof is located above the guide projections 95*a*.

A pattern of stripes extending in the extension of the center axis 31 and having a specified pitch is formed on the entire outer circumferential surface of metallic ring 34, and a photoreflector 36 (see FIG. 5) is provided in vicinity of the roller member 3. This photoreflector 36 is so constructed as to project a light onto the outer circumferential surface of the metallic ring 34 and receive the reflected light, and detects a rotating speed of the roller member 3 by detecting a change of the reflected light caused by the stripe pattern.

The sensor casing 4 is comprised of a casing main body 41 which is square in plan view and has a specified thickness, and a funnel-shaped portion 42 continuously formed below the casing main body 41 and having the shape of an inverted truncated rectangular pyramid. On the other hand, a rectangular window 92*b* (see FIG. 2) corresponding to the funnel-shaped portion 42 is formed in the bottom plate 92*a* of the lid 92. In the inner surfaces of the rectangular window 92*b* are formed slanted edge portions 92*c* corresponding to the inclination of the surrounding wall surfaces of the funnel-shaped portion 42 as shown in FIG. 5. The sensor casing 4 fitted into the rectangular window 92*b* from above is mounted in the lid 92 while having its bottom surface exposed to the outside by the engagement of the surrounding wall surfaces of the funnel-shaped portion 42 with the slanted edge portions 92*c*.

The sensor casing 4 has a substrate mounting recess 43 for mounting a substrate 5 to be described later formed in the upper surface of the casing main body 41 while having a glass substrate mounting chamber 44 for mounting the glass substrate 6 to be described later formed in the casing main body 41 such that the chamber 44 vertically penetrates the sensor casing 41. The chamber 44 has its upper part separated into a front section and a rear section by a partition plate 45. A LED mounting chamber 46 for mounting a LED 54 used to discriminate the genuineness of the bank note M is defined in the front (left in FIG. 5) section, whereas a light detecting device mounting chamber 47 for mounting the light detecting device 51 is defined in the rear section.

In the funnel-shaped portion 42 is provided a lead plate mounting recess 48 for mounting the lead plate 35, which recess is adjacent to the rear part of the glass substrate mounting chamber 44. The bent piece 35*b* of the lead plate 35 is fitted into the lead plate mounting recess 48 and fixed by screws or like means. The bent piece 35 is so dimensioned that its bottom end faces the top plate 950 (see FIG. 2) of the casing main body 91 with the lead plate 35 mounted in the sensor casing 4.

The substrate 5 is used to apply a specified electrical processing to an output of the light detecting device 51 mounted on its rear surface and to enable wiring, etc. for supplying a power to the LED 54. The light detecting device 51 is provided in a specified position of the light detecting device mounting chamber 47, whereas the LED 54 as a light emitting element is provided in a specified position of the LED mounting chamber 46.

The light detecting device 51 includes light detecting elements 52 for detecting a light from the light collecting spot P, and a plate-shaped element holder 53 for supporting the light detecting elements 52. The light detecting device 51 is mounted on the substrate 5 by fixing the element holder 53 to the rear surface of the substrate 5 via a specified coupling member.

The light detecting elements 52 are comprised of a first light detecting element 52*a* and a second light detecting element 52*b* arranged adjacent to each other. The first light detecting element 52*a* is adapted to detect a light from an electroluminescent material having a characteristic of emitting a light in an alternating-current electromagnetic field, i.e. a so-called electroluminescent light. In order to detect such an electroluminescent light, a band-pass filter 57 for causing only the electroluminescent light to transmit and cutting other lights is placed on the front surface of the first light detecting element 52*a*. Only the electroluminescent light can be made incident on the first light detecting element 52*a* by the presence of this band-pass filter 57.

On the other hand, the second light detecting element 52*b* is adapted to detect a visible light emitted from the LED 54 and reflected by the surface of the bank note M. In this embodiment, a wavelength of the light emitted from the LED 54 is differed from that of the electroluminescent light.

As shown in FIG. 3, the glass substrate 6 is formed by joining a first glass substrate 61 and a second glass substrate 62 which are trapezoidal in side view (when the glass substrate 6 is viewed in a direction of −X). The first glass substrate 61 has a first slanted surface 61*a* formed on its front surface and a second slanted surface 61*b* formed on its rear surface. The angles of these slanted surfaces are set such that the LED light from the LED 54 incident on the first glass substrate 61 is reflected by the first slanted surface 61*a*, the bottom surface of the fist glass substrate 61 and the second slanted surface 61*b* to reach the light collecting spot P. A semitransparent film 61*c* is formed on the second slanted surface 61*b*.

The front surface of the second glass substrate 62 is so slanted as to be held in surface contact with the second slanted surface 61*b* of the first glass substrate 61, and the rear surface thereof is a vertical surface. The glass substrate 6 is formed by placing the front surface of the second glass substrate 62 on the second slanted surface 61*b* of the first glass substrate 61.

A light emitted from the LED 54 propagates toward the first slanted surface 61*a* of the first glass substrate 61 and is reflected thereby to propagate toward the bottom surface of the first glass substrate 61, which bottom surface reflects the light toward the second slanted surface 61*b*, where the light is reflected by the semitransparent film 61*c* and propagates downward to be diffusely reflected at the light collecting spot P on the surface of the bank note M. Vertical components of the diffusely reflected light are incident on the light detecting elements 52 after transmitting through the first glass substrate 61, the semitransparent film 61*c* and the second glass substrate 62.

Electrically conductive ITO films 66 formed by depositing ITO (indium-tin-oxide) which is an oxide of an indium-tin alloy are formed on the bottom surface of the glass substrate 6 in contact with the bank note M and the vertical right surface thereof. The ITO films 66 serve as the other electrode facing the roller member 3 as one electrode. In this embodiment, the first detecting construction 71 (see FIG. 3) for detecting printing made using the so-called electroluminescent ink containing the electroluminescent material is constructed by the alternating-current power supply 30, the roller member 3, the lead plate 35, the glass substrate 6 and the first light detecting element 52*a*, and the second detecting construction 72 for detecting printing made by the usual ink on the electroluminescent ink is constructed by the LED 54, the glass substrate 6 and the second light detecting element 52*b*.

A genuineness discriminating mechanism according to this embodiment is constructed to discriminate genuineness of the bank note M by comparing detection signals from the first and second detecting constructions 71, 72 obtained with the lapse of time and checking a correlation between the respective detection signals.

Before describing such a genuineness discriminating mechanism, printing made on the bank note M to be discriminated is described. FIG. 6 is a perspective view showing an exemplary printed state of the bank note M. FIGS. 7A and 7B are enlarged sections along C-C of FIG. 6, wherein FIG. 7A shows a state where printing is made by a usual nonluminescent ink on an electroluminescent ink and FIG. 7B shows a state where printing is made using a mixed ink obtained by mixing the usual nonluminescent ink and the electroluminescent ink.

A multitude of various characters, figures and/or symbols are printed on the surface of the bank note M. In an example of FIG. 6, a letter "S" and four points are printed on the surface of the bank note M such that the four points surround the letter "S" in order to facilitate and simplify the description. The bank note M inserted into the note passing slit 95 (see FIG. 1) of the discriminating apparatus 1 is pulled toward the back of the note passing slit 95 by the rotation of the transport rollers 95*c* (see FIG. 2), and a portion of the bank note M indicated by phantom line in FIG. 6 is successively scanned by a relative movement of the light detecting device 51 with respect to the bank note M. Specifically, the light projected onto the light collecting spot P (see FIG. 5) of the bank note from the LED 54 and reflected by the surface of the bank note M is detected by the second light detecting element 52*b* as time passes, and the light emitted from the electroluminescent ink at the light collecting spot P caused by the inside of the note passing slit 95 becoming an alternating-current electromagnetic field is detected by the first light detecting element 52*a* as time passes. The detection results of the first and second light detecting elements 52*a*, 52*b* are compared by the control unit 8 to discriminate the genuineness of the bank note M.

Such a bank note M is, as shown in FIG. 7, comprised of a base sheet M1, a coating layer M2 formed on the outer surface of the base sheet M1 by applying coating of a specified coating material in order to smoothen a printing surface, and printed protuberant portions M3 formed by applying printing to the outer surface of the coating layer M2.

The printed protuberant portion M3 is made up of an electroluminescent ink portion M31 printed by the electroluminescent ink and a usual ink portion M32 formed by applying the usual printing ink on the electroluminescent ink portion M31 in an example shown in FIG. 7A. An ink which causes the electroluminescent light to transmit and has a wavelength different from that of the electroluminescent light is adopted as the ink of the usual ink portion M32.

On the other hand, the printed protuberant portion M3 shown in an example of FIG. 7B is made of the ink obtained by mixing ultrafine particles (electroluminescent ultrafine particles 31') into an ink base 32' made of a printing ink similar to the usual ink portion M32. Which of the printed protuberant portions M3 is formed does not make any difference in discrimination of genuineness of the bank note M by means of scanning of the light detecting elements 51.

When the bank note M having such printed protuberant portions M3 formed thereon is inserted into the note passing slit 95 of the discriminating apparatus 1, the unillustrated sensor detects it, the transport rollers 95*c* are driven by a power supply from the alternating-current power supply in response to the detection signal from the sensor to pull the bank note M to the back of the note passing slit 95, and the LED 54 is driven. The bank note M is inserted between the insulating ring 33 of the roller member 3 and the glass substrate 6 (see FIG. 5) in this state, passes through the note passing slit 95 while being held in sliding contact with the insulating ring 33 and the glass substrate 6, and is scanned by the light detecting device 51.

When the printed protuberant portion M3 (see FIGS. 6 and 7) of the bank note M reaches the light collecting spot P (see FIG. 5) in the note passing slit 95 during scanning, the second light detecting element 52*b* detects a reflected light from the electroluminescent ink portion M31 (see FIG. 7A) or the electroluminescent ultrafine particles M31' (see FIG. 7B) and power from the power supply 30 is accordingly supplied to the roller member 3 and the ITO films 66 to set the environment of the alternating-current electromagnetic field at the light collecting spot P. Then, a light is emitted from the electroluminescent ink portion M31 of the printed protuberant portion M3, components of this light propagating upward of the glass substrate 6 are detected by the first light detecting element 52*a* after crossing upward in the glass substrate 6, and a light emitted from the LED 54 is detected by the second light detecting element 52*b*.

FIGS. 8A, 8B and 8C are graphs changes of output values in proportion to amounts of light detected by a light detecting element during the operation of a light detecting device, wherein FIG. 8A shows a change of the output value over time in the case that the amount of light is outputted as it is without being processed, FIG. 8B shows a change of the output value over time in the case that an analog signal of the amount of detected light is passed through a high-pass filter, and FIG. 8C shows a change of the output value over time in the case that the analog signal of the amount of detected light is passed through a low-pass filter, FIG. 8D is a graph showing spectral sensitivity characteristics of the first and second light detecting elements 52*a*, 52*b*. In this graph, horizontal axis represents wavelength λ, and vertical axis represents sensitivity S. As can be seen from this graph, the sensitivity S of the first light detecting element 52*a* for detecting the electroluminescent light detects rays in a specified wavelength range where the wavelength λ is short, whereas the sensitivity S of the second light detecting element 52*b* detects rays in a specified wavelength range having a wavelength λ longer than the wavelength range of the first light detecting element 52*a*. In other words, the first and second light detecting elements 52*a*, 52*b* detect lights in different wavelength ranges. This can be realized by arranging an optical filter (band-pass filter) having a wavelength selecting property on the detecting surface of each of the two light detecting elements.

Accordingly, the fluorescent light and the electroluminescent light can be discriminated based on the outputs of the first and second light detecting elements 52*a*, 52*b*. FIG. 9A is a block diagram showing one embodiment of a light detection control by the control unit 8. As shown in FIG. 9A, the genuineness discriminating control for the bank note M is executed by the control unit 8 provided internally with a CPU (central processing unit) 80. With the CPU 80 are connected a RAM (random access memory) 81 and a ROM (read only memory) 82. The CPU 80 is provided with a function of controlling the entire system and calculating the outputs from the light detecting elements 52.

The RAM 81 is an external storage device in and from which data can be freely written and read, and output values from the first and second light detecting elements 52*a*, 52*b* with the lapse of time, results of specified calculation processings are inputted to the RAM 81 and, if necessary, various values including results of intermediate processings and calculations are outputted therefrom. The ROM 82 is an external storage device exclusively for reading purpose, and a program for the genuineness discrimination (correlation calculating means) is stored in advance. Upon application of a power to the certified paper discriminating apparatus 1 by operating the power switch 96, the program in the ROM 82 is transferred to the CPU 80. Every time the bank note M is inserted into the note passing slit 95, the CPU 80 outputs drive signals to various devices and performs a genuineness discrimination calculation based on the detection signals from the first and second light detecting elements 52*a*, 52*b* in accordance with the program.

A first inverter 801 is connected with one of output ports of the CPU 80, and a second inverter 802 is connected with an other one thereof. The first inverter 801 turns on and off a transistor 803 connected with its output terminal in accordance with a signal outputted from the CPU 80, thereby controllably turning the LED 55 on and off. The second inverter 802 similarly turns a transistor 804 on and off to controllably turn the LED 54 on and off.

Since the LED 55 is normally on, the light detecting element 56 detects LED light. However, when the bank note M is inserted into the note passing slit 95, it blocks an optical path to interrupt the light detection of the light detecting element 56, with the result that the supply of the bank note M into the discriminating apparatus 1 can be discriminated.

An operational amplifier 805 and a comparator 806 are connected in series between the light detecting element 56 and the CPU 80. The operational amplifier 805 amplifies an output of the LED 55 having detected by the light detecting element 56, and the comparator 806 outputs a detection signal to the CPU 80 if an output value of the operational amplifier 805 exceeds a predetermined level. Disturbance is cut by such a construction.

Further, an operational amplifier 807, a low-pass filter 808 formed by a specified resistor and a capacitor, a band-rejection filter 810 formed by a specified resistor, a capacitor and an operational amplifier 809 are provided in series between the first light detecting element 52*a* for detecting the electroluminescent light via the band-pass filter 57 and the CPU 80. The band-rejection filter 810 is adapted to cut an electrical noise from an inverter 821 to be described later which noise is mixed into the output from the first light detecting element 52*a*.

An amplifying circuit 812 adapted to amplify an output from the band-rejection filter 810 and formed by a specified resistor and an operational amplifier 811, and a peak holding circuit 815 formed by a specified resistor, a capacitor and operational amplifiers 813, 814 are provided between the first light detecting element 52*a* and the CPU 80. The peak holding circuit 815 is adapted to output a first value of a specified period of a signal outputted from the first light detecting element 52*a*.

An output value from the peak holding circuit 815 in the form of an analog signal is inputted to the CPU 80 after being converted into a digital signal by an analog-to-digital (A/D) converter 816.

An operational amplifier 817, a low-pass filter 818 formed by combining a specified resistor and a capacitor, an amplifying circuit 819 formed by a specified resistor and an operational amplifier 819, and an A/D converter 820 are provided between the second light detecting element 52*b* for detecting the LED light from the LED 54 and the CPU 80.

An inverter 821 for applying an alternating voltage having a specified value to the roller member 3 and the lead plate 35 and a switching circuit 822 are provided between the roller member 3 and the lead plate 35 and the alternating-current power supply 30 (see FIG. 5) (the inverter 821 and the switching circuit 822 are not shown in FIG. 5). An alternating-current electromagnetic field between the roller member 3 and the lead plate 35 is generated and canceled by turning the switching circuit 822 on and off in accordance with a control signal from the CPU 80.

A motor control circuit 823 for controllably driving an unillustrated motor used for mechanical drive in the discriminating apparatus 1 is connected with an output port of the CPU 80. The motor is driven via the motor control circuit 823 in accordance with a drive signal from the CPU 80 based on, e.g. a detection signal from the light detecting element 56 to thereby perform its mechanical functions such as pulling of the bank note M into the note passing slit 95 by the rotation of the transport rollers 95*c*.

Upon input of an output signal from the photoreflector 36 to the CPU 80, the number of rotation of the roller member 3, i.e. the transporting speed of the bank note M in the note passing slit 95 can be detected. The CPU 80 sends a signal representing a genuineness discrimination result for the bank note M to the display lamp assembly 98.

The CPU 80 is provided with an alternating voltage control means 80*a* and a genuineness discriminating means 80*b*. The control means 80*a* judges that a portion of the bank note M emitting the electroluminescent light has reached the light collecting spot P upon receipt of a detection signal from the first light detecting element 52*a*, outputs a switch-on control signal to the switching circuit 822 to cause the electroluminescent ink portion M31 of the printed protuberant portion M3 to emit a light, and outputs a switch-off control signal to the switching circuit 822 upon judging that the electroluminescent ink portion M31 have moved beyond the light collecting spot P when it stops receiving the detection signal from the first light detecting element 52*a*.

Accordingly, the bank note M is exposed to the environment of the alternating-current electromagnetic field only until the electroluminescent ink portion M31 reaches the light collecting spot P, but not exposed thereto after passing the light collecting spot P by the control of the alternating voltage control means 80*a*. Thus, deterioration of the bank note M caused by being exposed to the environment of the alternating-current electromagnetic field over a long time can be prevented. Simultaneously it prevents deterioration of insulating members covering the electrodes from being advanced by applying a high voltage between the electrodes for a time longer than necessary.

The genuineness discriminating means 80*b* applies a specified calculation to the received output values from the first and second light detecting elements 52*a*, 52*b* to discriminate the genuineness of the bank note M. In the ROM 82 is stored the correlation calculating means for comparing the output values from the respective light detecting elements 52*a*, 52*b* and calculating a correlation between them. The PCU 80 calls this correlation calculating means during the genuineness discrimination to compare the respective output values with the light detection pattern of a genuine bank note M stored beforehand. The bank note M being discriminated is judged to be genuine by confirming that a difference between them is smaller than a specified level.

In FIG. 9B, a block diagram shows an alternative embodiment of the genuineness discriminating control by the control unit 8 based on the output values of the light detecting element 72. As shown in FIG. 9B, the genuineness discriminating control for the bank note M and a drive control of the discriminating apparatus 1 are executed by the control unit 8 provided internally with a CPU (central processing unit) 80. With the CPU 80 are connected a RAM (random access memory) 81 and a ROM (read only memory) 82.

The RAM 81 is an external storage device in and from which data can be freely written and read, and output values from the light detecting element 72 with the lapse of time, results of specified calculation processings are inputted to the RAM 81 and, if necessary, various values including results of intermediate processings and calculations are outputted therefrom. The ROM 82 is an external storage device exclusively for reading purpose, and a program for a comparison calculation of the genuineness discrimination is stored in advance. Upon application of a power to the discriminating apparatus 1 by operating the power switch 96, the program in the ROM 82 is transferred to the CPU 80 for the calculation.

Every time the bank note M is inserted into the note passing slit 95, the control unit 8 outputs drive signals to various devices and discriminates the genuineness of the bank note M by comparing a pattern of the output values (light intensities) from the light detecting element 72 with the pattern of the genuine bank note stored beforehand in accordance with the program.

An amplifier 83 is provided between the CPU 80 of the control unit 8 and the light detecting element 72 (the electrical contacts 73 and the substrate 5 shown in FIG. 3 are not shown in FIG. 9B), and a high-pass filter 831 and a low-pass filter 832 are provided in parallel between the amplifier 83 and the CPU 80. The amplifier 83 amplifies feeble detection signals from the light detecting element 72; the high-pass filter 831 transmits high-frequency components of the output of the light detecting element 72; and the low-pass filter 832 transmits low-frequency components of the output of the light detecting element 72.

Analog-to-digital (A/D) converters 833 are connected between the respective filters 831, 832 and the CPU 80 for converting analog signals from the respective amplifiers 521*a*, 531*a*, 522*a* into digital signals.

After being amplified by the amplifier 83, an analog output value from the light detecting element 72 becomes an amplified analog output signal, which is then split into two parts, one of which is passed through the high-pass filter 831 and the other of which is fed to the low-pass filter 832. The outputs from the filters 831, 832 are fed to the A/D converters 833 to be converted into digital signals, which are then inputted to the control unit 8.

Power from the alternating-current power supply 39 is supplied to the roller member 3 and the electrode member 6 via a switching circuit 391 and the inverter 38. The inverter 38 supplies an alternating voltage from the power supply 39 to the roller member 3 and the electrode member 6 after converting it into an alternating voltage having a specified voltage value and a specified frequency. The power supply to the roller member 3 and the electrode member 6 is turned on and off by the operation of the switching circuit 391 in accordance with a control signal outputted from the CPU 80, and the inverter 38 sets the specified voltage value and frequency when the power supply is on.

The power supply is not limited to the alternating-current power supply, and may be a direct-current power supply.

A monitoring circuit 381 and an A/D converter 382 are provided between the inverter 38 and the CPU 80. The monitoring circuit 381 is adapted to monitor (detect) a value of a current flowing into the inverter 38, and the current value monitored by the monitoring circuit 381 is inputted to the CPU 80 after being digitized by the A/D converter 382. The CPU 80 discriminates whether this current value lies within a preset current value range and causes an alarm to be outputted to notify an occurrence of an abnormal situation and turns the switching circuit 391 off if the current value lies outside the range.

A detection signal representing the rotating speed of the roller member 3 (specifically the number of stripes 33*a* provided on the outer circumferential surface of the insulating ring 33 passing a detecting position per unit time) is inputted from the photoreflector 36 to the CPU 80, and a timing pulse corresponding to this input value is sent to the respective AND converters 833 via an unillustrated timing pulse generating circuit. This timing pulse generating circuit sends so-called timing signals representing specified periods used in converting an analog signal into a digital signal to the A/D converters 833. A first analog value or an average analog value during the period defined by the timing signal is converted into a digital value.

The detection signal from the note detecting sensor (certified paper detecting means) 37 for detecting the insertion of the bank note M into the note passing slit 95 is also inputted to the CPU 80. Upon receipt of this detection signal, the CPU 80 calculates a timing when the leading end of the bank note M will reach the light collecting spot P and outputs a control signal to the switching circuit 391 upon reaching this timing. Accordingly, the environment of the alternating-current electromagnetic field is set at the light collecting spot P when the leading end of the bank note M reaches the light collecting spot P and, therefore, the bank note M emits a light. Further, the switching circuit 391 is turned off in response to a control signal from the CPU 80 after the lapse of a predetermined period following the detection of the trailing end of the bank note M by the note detecting sensor 37, thereby canceling the environment of the alternating-current electromagnetic field at the light collecting spot P.

When the thus digitized output values of the light detecting element 72 are inputted to the CPU 80, the CPU 80 applies a specified calculation to the inputted output values to discriminate the genuineness of the bank note M.

For this genuineness discrimination, the CPU 80 is provided with a light intensity comparing means 800A for comparing the digital output values from the light detecting element 72 and a pattern of light intensities (reference light intensities) of the output values of the genuine bank note M over time which is set and stored beforehand in the RAM 81, a genuineness discriminating means 80*b* for discriminating the genuineness of the bank note M based on a comparison result of the light intensity comparing means 800A, and an abnormality detecting means 800C for detecting that a voltage at the light collecting spot P has become higher than a voltage environment set in advance.

In the light intensity comparing means 800A, every time the digital output value is inputted from the light detecting element 72, it is compared with the preset reference light intensity to calculate a deviation, which is then stored in the RAM 81. In the genuineness discriminating means 80*b*, the deviations successively stored in the RAM 81 are read and verified by a statistical method. The bank note M fed to the discriminating apparatus 1 is discriminated to be genuine if no significant difference is found between the received digital output values and the reference light intensities while being discriminated to be counterfeit unless otherwise.

In the abnormality detecting means 800C, whether or not a current value inputted from the inverter 38 via the monitoring circuit 381 and the A/D converter 382 exceeds a preset current value is discriminated. If the discrimination result is affirmative, the CPU 80 outputs a stop signal to the switching circuit 391, which in turn cuts off a current supply to the roller member 3 and the electrode member 6. By providing such an abnormality detecting means 800C, an undesirable event where an abnormally high voltage environment is set at the light collecting spot P to damage the bank note M can be securely prevented from occurring. Other undesirable cases can also be considered such as the one where an external matter enters to destroy an insulated state of the electrodes. Such undesirable cases (e.g. damage of the electrodes) can also be hindered.

The discrimination result on the genuineness of the bank note M is outputted to the display lamp assembly 98, and the genuineness of the bank note M having passed through the note passing slit 95 can be visually confirmed by seeing which of the success lamp 98*b* and the failure lamp 98*c* is on. Further, it can be confirmed by seeing the ready lamp 98*a* turned on that the certified paper discriminating apparatus 1 can receive the bank note M.

The control unit 8 is also provided with a drive control circuit 84 for outputting drive signals to various devices (the transport rollers 95*c*, unillustrated flappers, etc.) provided in the discriminating apparatus 1. The respective devices in the discriminating apparatus 1 operate while being interrelated with each other in accordance with control signals sent from the control unit 8 via the drive control circuit 84.

FIG. 10A is a flow chart showing a bank note scanning control routine with further reference to FIG. 9A. When scanning of the bank note M is started (Step S1), the power switch 96 is first turned on (Step S2) and accordingly the CPU 80 calls the program stored in the ROM 82 to start this program, thereby clearing various counters, registers, flags, etc., i.e. performing a so-called initialization.

Subsequently, it is discriminated based on the detection signal from the light detecting element 56 whether the bank note M has been inserted into the note passing slit 95. When the bank note M is inserted into the note passing slit 95 (YES in Step S4), a light from the LED 55 is blocked by the bank note M to decrease an output of the light detecting element 56. Such a decrease is inputted to the CPU 80 via the operational amplifier 805 and the low-pass filter 808, and the CPU 80 in turn outputs a control signal to the unillustrated transport motor via the motor control circuit 823 and the bank note M is pulled into the note passing slit 95 by the driving of the transport motor (Step S5).

Then, the LED 54 is turned on in accordance with a control signal from the CPU 80 (Step S6). The LED light from the LED 54 is projected to a portion of the bank note M being transported located at the light collecting spot P, and the light reflected thereby propagates to and are detected by the first and second light detecting elements 52*a*, 52*b* (Step S7). The output value of the first light detecting element 52*a* is "0" until the electroluminescent light from the electroluminescent ink portion M31 is detected by the first light detecting element 52*a*.

In Step S8, the amount of light detected by the first light detecting element 52*a* is compared with a specified value stored in the ROM 82 beforehand. Step S9 is executed if the amount of light is equal to or larger than the specified value (YES in Step S8) while this routine proceeds to Step S18 to return to Step S6 and repeat the above operations until the amount of light detected by the first light detecting element 52*a* becomes equal to or larger than the specified value if the amount of light is below the specified value.

When the amount of light detected by the first light detecting element 52*a* is equal to or larger than the specified value, i.e. emission of fluorescent light at the light collecting spot P is confirmed, the LED 54 is turned off (Step S9) and then the switching circuit 822 is caused to drive the inverter 821 in accordance with a control signal from the CPU 80, thereby setting the environment of the alternating-current electromagnetic field at the light collecting spot P. As a result, the electroluminescent ink portion M3 emits a light. This light emission is detected by the first light detecting element 52*a* and its data is sent to the CPU 80 (Step S11).

Subsequently, Step S12 is executed to discriminate whether the currently obtained amount of light detected by the first light detecting element 52*a* is equal to or larger than a specified value set beforehand (Step S12). The detected light is judged to be an electroluminescent light if the amount of light is equal to or larger than the specified value (YES in Step S12) and operations in Step S13 and subsequent Steps are carried out. This routine skips to Step S18 if the amount of light is smaller than the specified value.

In Step 13, the amount of light detected by the second light detecting element 52*b* is fed to the CPU 80, which in turn discriminates whether the currently obtained amount of light detected by the second light detecting element 52*a* is equal to or larger than a specified value set beforehand (Step S14).

A fluorescent light flag is set (Step S15) upon judging that a fluorescent light (light emission distribution at the right side of FIG. 8A) is emitted from the surface of the bank note M if the amount of light detected by the second light detecting element 52*b* is equal to or larger than the specified value (YES in Step S14). On the other hand, an electroluminescent light flag is set (Step S16) upon judging that only an electroluminescent light is emitted from the surface of the bank note M if the amount of light detected by the second light detecting element 52*b* is below the specified value (NO in Step S14). After the inverter 821 is turned off (Step S17), it is discriminated whether the transport of the bank note M in the note passing slit 95 has been completed (Step S18).

Unless the transport of the bank note M has been completed (NO in Step S18), this routine returns to Step S6. If it has been completed, the transport motor is stopped in accordance with a signal from the motor control circuit 823 (Step S20) after the LED 54 is turned off (Step S19). The genuineness discriminating means 80*b* then discriminates the genuineness of the bank note M and outputs a discrimination result to the display lamp assembly 98 (Step S21), thereby ending a series of operations for the genuineness discrimination (Step S22).

As described in detail above, an alternating voltage is applied to the bank note M only while the electroluminescent ink portion M31 is located at the light collecting spot P. Accordingly, a period during which the bank note M is exposed to the high-voltage alternating-current electromagnetic field is shortened as compared to a case where it is transported with the environment of the high-voltage alternating-current electromagnetic field set at the light collecting spot P from the beginning on. This minimizes an influence on the quality of the bank note M caused by a long exposure time, thereby avoiding an undesirable event where deterioration of the bank note M is advanced by the genuineness discrimination.

Next, an alternative embodiment of the data sampling control by the control unit 8 is described with reference to FIG. 10B. FIG. 10B is a flow chart showing a data sampling routine for storing the light emission data of the bank note M scanned by the light detecting element 72 of FIG. 9B. First, when the data sampling routine is started in Step S1, the CPU 80 of the control unit 8 clears various counters, registers and flags, initializes the respective mechanism and sets the transport mechanism such as the transport rollers 95 in an operation start standby state in accordance with the program called from the ROM 82 (Step S2).

When the bank note M to be discriminated is inserted into the note passing slit 95 in this state, it is detected by the note detecting sensor 37 (Step S3) and the CPU 80 outputs an operation start signal to the transport mechanism and the bank note M is pulled into the note passing slit 95 by the rotation of the transport rollers 95*c* (Step S4). If no bank note M is inserted into the note passing slit 95 in Step S3, Step S3 is repeated until the bank note M is inserted into the note passing slit 95.

Upon the lapse of the predetermined period (period which lapses until the leading end of the bank note M reaches the light collecting spot P) after the detection of the bank note M by the note detecting sensor 37, the switching circuit 391 is turned on in accordance with a control signal from the CPU 80 to supply a power from the alternating-current power supply 39 to the inverter 38 (Step S5), whereby an alternating voltage having a specified voltage value is applied to the roller member 3 and the electrode member 6 to set the environment of the alternating-current electromagnetic field inside the note passing slit 95.

In Step S6, the monitoring circuit 381 detects a current flowing into the inverter 38 and the detected current value is inputted to the CPU 80 after being digitally converted by the AID converter 382. If this current value exceeds a threshold value set beforehand, a first timer is started after skipping Step S7. After the lapse of the predetermined period (Step S8), the CPU 80 sends a signal to the switching circuit 391 to turn it off, thereby stopping the inverter 38 (Step S12), stopping the transport of the bank note M (Step S13), and displaying a warning (Step S14) to then end this routine. Such an arrangement hinders application of a voltage higher than necessary to the roller member 3 and the electrode member 6, thereby preventing deterioration of the roller member 3 and the electrode member 6 from being advanced.

If the current value is below the threshold value in Step S6, a second timer is started (Step S9) and it is then discriminated whether a pulse from the photoreflector 36 based on the stripe pattern 33*a* on the outer surface of the insulating ring 33 has been detected (Step S10). If no pulse has been detected, it is discriminated whether a predetermined period has elapsed after the start of the second timer (Step S11).

Unless the predetermined period has elapsed, this routine returns to Step S10 to repeat Steps S10 and S11. If the second timer measures the predetermined period while no pulse is detected during the repeated operations of Steps S10 and S11, Step S12 and succeeding Steps are executed to respond to an occurrence of an abnormality upon judgment that the roller member 3 is not rotating, thereby stopping the transport mechanism, displaying a warning and ending this routine. Such an arrangement hinders application of a voltage higher than necessary to the roller member 3 and the electrode member 6 in the absence of the bank note M, thereby preventing deterioration of the roller member 3 and the electrode member 6 from being advanced.

On the other hand, if a pulse corresponding to the stripe pattern 33*a* of the insulating ring 33 from the photoreflector 36 is detected in Step S10, the bank note M in the environment of the high-voltage alternating-current electromagnetic field emits a light by the corona discharge and the light emission at the light collecting spot P is detected by the light detecting element 72 and inputted to the CPU 80 to be stored in the specified storage device (e.g. RAM 81) (Step S16). Subsequently, the first and second timers are reset (Steps S17, S18), and whether the transport of the bank note M has been completed is discriminated based on whether a pulse signal from the photoreflector 36 has been stopped. This routine is returned to Step S6 to repeat the operations of succeeding Steps during the transport of the bank note M during which the pulse signal is being sent, whereas the inverter 38 is stopped upon judging that the transport of the bank note M has been completed, thereby completing the data sampling for the genuineness discrimination of the bank note M (Step S21).

As described in detail above, in the inventive discriminating apparatus 1, genuineness is discriminated by detecting the light emitted from the bank note M placed in the environment of the high-voltage alternating-current electromagnetic field created by the corona discharge. This light is emitted not only from the specified positions where the security mark and the like are printed for the genuineness discrimination, but also from the base portion of the bank note M. By storing a distribution of light emission resulting from the corona discharge over the entire surface of a genuine bank note M beforehand, the inventive discriminating apparatus can more securely discriminate the genuineness of the bank note M than the conventional discriminating apparatuses by comparing the distribution of light emission of the genuine bank note M with that of the bank note M being discriminated by means of the genuineness discriminating means.

Since the light emission from the bank note M caused by the corona discharge varies depending on the thickness distribution of the bank note M, the presence of various printing inks, and the size of ink particles, etc., forgery of certified papers whose genuineness is difficult to discriminate merely by selecting a printing ink can be suppressed by specifying the thickness distribution of the genuine certified paper and using various printing inks in combination with the thickness distribution. Even if bank notes are forged, such bank notes can be easily and securely discriminated.

FIG. 11 is a side view of a second embodiment of the sensor construction. This sensor construction is suited to detecting a security pattern printed by a special printing technique using an ink obtained by mixing a metallic luster ink having a metallic powder as a base into an electroluminescent ink in order to display images and colors which differ depending on angle. Instead of the glass substrate 6 formed by placing the two glass substrates (61, 62) one over the other, a unitary glass prism 60 is used in the sensor casing 4.

The glass prism 60 has a transversely symmetric pentagonal shape in front view, and is formed with a right slanted surface 60*a* normal to an optic axis of the LED 54, a ceiling surface 60*b* horizontally extending from the left end of the right slanted surface 60*a* in FIG. 11, and a left slanted surface 60*c* extending from the left end of the ceiling surface 60*b* and symmetrical with the right slanted surface 60*a*. A solid shape of the glass prism 60 is so set that the light collecting spot P with respect to the bank note M is located at an intersection of a vertically extending center line thereof and the optic axis of the LED 54. The other construction of this sensor construction is similar to that of the previous embodiment.

The use of such a glass prism 60 enables the presence of the printed protuberant portion M3 (security pattern) to be more effectively detected if the printing pattern is so formed as to change a wavelength depending on direction of reflection and the light detection sensitivity characteristics of the respective light detecting elements 52*a*, 52*b* are set to correspond to such a printing pattern.

Further in this embodiment, the presence of the security pattern is detected in accordance with the output signals from the two light detecting elements 52*a*, 52*b* representing the light emitted from the LED 54 and reflected by the bank note M, and the presence of the electroluminescent light is detected by setting the environment of the alternating-current electromagnetic field at the light collecting spot P instead of by stopping the light emission from the LED 54 when the security pattern is detected. Thus, an inconvenience that the bank note M is constantly exposed to the environment of the alternating-current electromagnetic field can be avoided.

Although the printing pattern is so formed as to change a wavelength depending on direction of reflection in this embodiment, reflection characteristic may be provided with a peculiar distinction or reflection pattern may be differed depending on angle.

Since the alternating voltage is applied to the certified paper only when the fluorescent ink is located at the light collecting spot, a period during which the certified paper is exposed to the high-voltage alternating-current electromagnetic field is shortened as compared to a case where it is transported with the environment of the high-voltage alternating-current electromagnetic field set at the light collecting spot P from the beginning on. This minimizes an influence on the quality of the certified paper caused by a long exposure time, thereby avoiding an undesirable situation where deterioration of the bank note M is advanced by the genuineness discrimination.

Further, the light emitted from the fluorescent ink on the certified paper located at the light collecting spot and the light emitted from the light source and reflected at the light collecting spot are both inputted to the genuineness discriminating means, and the genuineness discriminating means discriminate the genuineness of the certified paper based on these two output values. Therefore, precision of the genuineness discrimination can be improved.

FIG. 12 is a side view in section showing a second embodiment of the sensor construction. In this embodiment, a pair of upper and lower cylindrical lenses 602, 603 provided with an electrode function are used instead of the roller member 3 used in the foregoing embodiment as an electrode. A corona discharge is created by moving a bank note M while tightly holding it between the upper and lower cylindrical lenses 602, 603 to which a high alternating voltage is applied, and a resulting light emission from the bank note M is detected by a light detecting element via the cylindrical lenses.

Hereinafter, the second embodiment of the sensor construction is described in detail with reference to FIG. 12. This sensor construction is provided with a pair of upper and lower electrode members 6*a* mounted on facing surfaces of a pair of upper and lower metallic sensor casings 4*a*, light detecting devices 7 provided at ends of the sensor casings 4*a* opposite from the electrode members 6*a*, and an alternating current power supply unit 390 for applying a high alternating voltage to the respective electrode members 6*a*. The unit 390 includes the alternating-current power supply 39 described above, a switching circuit 39*a*, an inverter 38, etc.

Each sensor casing 4*a* has a tubular shape, holds the electrode member 6*a* and the light detecting device 7 in specified positions and acts to prevent a high electromagnetic field noise from the power supply unit 390 from influencing a light detecting element 72. Such a sensor casing 4*a* is formed with a lens mounting recess 401 formed one end surface, a light detecting device mounting recess 402 formed in the other end surface and an optical-path hole 403 between the recesses 401 and 402 for introducing a light having transmitted through the electrode member 6*a* to the light detecting element 72 of the light detecting device 7.

Flanges 404 are provided on the outer circumferential surfaces of the respective sensor casings 4*a*, and coil springs 405 fitted on the sensor casings 4*a* press the respective flanges 404 toward each other, whereby the upper and lower electrode members 6*a* provided on the sensor casings 4*a* to face each other are uniformly and linearly brought into contact with each other.

FIG. 13 is a perspective view of one embodiment of the electrode member 6*a*. As shown in FIG. 13, the electrode member 6*a* is made of a glass material, is long in widthwise direction (direction of X-X) as a whole, and is comprised of a lens portion 601 in the middle, and projecting edges 604 projecting outward (direction of Y-Y) from front and rear edges of the lens portion 601. The electrode member 6*a* is mounted in the sensor casing 4*a* by fitting the projecting edges 604 in the lens mounting recess 401.

The lens portion 601 is comprised of a first lens 602 formed at either one of the upper and lower sides with the projecting edges 604 as a boundary and accommodated in the optical-path hole 403, and a second lens 603 formed at the other side and exposed to the outside. The upper and lower electrode members 6*a* are so mounted on the respective sensor casings 4*a* that the second lenses 603 thereof face each other.

A cylindrical lens forming the second lens 603 is a lens basically having a curvature only in one direction and is arcuate in forward and backward directions while being linear in widthwise direction. Thus, the upper and lower second lenses 60 are in line contact with each other. Contrary to this, the first lens 602 is arcuate not only in forward and backward directions, but also in widthwise direction so that its center portion also projects upward in widthwise direction. Such a shape provides the first lenses 602 with a function of efficiently gathering a light to the corresponding light detecting elements 72.

A transparent conductive film 62 and a transparent insulating thin film 63 similar to those described above are successively formed on the respective second lenses 603, and the upper and lower transparent conductive films 62 act as electrodes for applying a high alternating voltage to the bank note M tightly held between the upper and lower transparent insulating thin films 63.

The transparent conductive films 62 are also formed on the entire surfaces of the first lenses 602. By the formation of the transparent conductive films 62, the optical-path 403 of each sensor casing 4*a* has its three sides covered by conductors to realize an electromagnetically shielded structure in the optical-path hole 403. Such a shielded structure prevents intrusion of external random electromagnetic waves into the optical-path hole 403.

A metallic thin film 605 electrically connected with the transparent conductive film 62 is formed in a specified position of the outer surface of each projecting edge 604. By connecting the metallic thin film 605 and the power supply unit 390 with each other, a high alternating voltage from the power supply unit 390 is applied to the respective transparent conductive films 62 and, accordingly, a light is emitted from the bank note M tightly held between the upper and lower electrode members 6*a* caused by a corona discharge. A light collecting spot P for collecting the light from the bank note M is formed at a contact position of the upper and lower transparent insulating films 63.

According to the sensor construction of the second embodiment, when the bank note M is fed to between the upper and lower electrode members 6*a* by the rotation of the transport rollers 95*c* with a high alternating voltage from the power supply unit 390 applied to the respective electrode members 6*a*, it enters between the second lenses 603 of the electrode members 6*a*. Since an environment of a high-voltage alternating-current current electromagnetic field is set between the second lenses 603 at this stage, the bank note M is caused to emit a light by the corona discharge and the light from the light collecting spot P is detected by the light detecting element 72 after transmitting through the lens portion 601 to be used for the genuineness discrimination in the procedure described above.

Since the electromagnetic field generating means does not include a movable portion by adopting the electrode members 6*a* instead of the roller member 3, the construction of the apparatus can be simplified. Further, since the electrode members 6*a* are arranged one over the other, the front and rear surfaces of the bank note M can be simultaneously scanned by one operation, thereby eliminating a cumbersomeness of inserting the bank note M having passed through the discriminating apparatus 1 again into the discriminating apparatus after turning it upside down. This leads to an improved operability of the genuineness discrimination.

FIG. 14 is a side view in section showing a modified embodiment of the sensor construction of the second embodiment shown in FIG. 12. In this embodiment, a mount hole 406 is so formed in one side wall of the sensor casing 4*a* as to communicate with an optical-path hole 40, and a LED member 600 having a built-in LED chip 600*c* as a light emitting element is fitted into this mount hole 406. A reflecting surface 600*a* for reflecting a LED light from the LED chip 600*c* downward is formed at the top of the leading end of the LED member 600, and a convex lens 600*b* having its orientation set such that the LED light from the reflecting surface 600*a* propagates toward the light collecting spot P via the lens portion 601 of the electrode member 6*a* is provided at the bottom of the leading end of the LED member 600.

According to this embodiment, the LED light from the LED chip 600*c* is projected to the light collecting spot P via the reflecting surface 600*a*, the convex lens 600*b* of the LED member 600 and the lens portion 601 of the electrode member 6*a*. Thus, a reflected light from the bank note M located at the light collecting spot P is detected by the light detecting device 7 through the lens portion 601. Therefore, if a wavelength of the LED light emitted from the LED chip 600*c* is differed from that of the light emitted from the bank note M by the corona discharge, the lights detected by the light detecting device 7 can be distinguished using, for example, a color sensor. As a result, precision in discriminating the genuineness of the bank note M can be improved.

According to the present invention, the certified paper is placed in the environment of the electromagnetic field where the corona discharge can occur, and genuineness is discriminated by detecting a light emitted therefrom by the light detecting means. By placing the certified paper in the environment of the electromagnetic field where the corona discharge can occur, the light resulting from the corona discharge is emitted from the certified paper. This light is emitted from the entire surface of the certified paper including the base portion thereof. Therefore, by storing a distribution of light emission resulting from the corona discharge over the entire surface of a genuine certified paper in the apparatus beforehand, the genuineness of the certified paper can be securely discriminated by comparing the distribution of light emission of the genuine certified paper with that of the certified paper being discriminated.

The discriminating apparatus may be further provided with the electromagnetic field generating means for generating an electromagnetic field, the transporting means for transporting the certified paper to cross the electromagnetic field generated by the electromagnetic field generating means, and the certified paper detecting means for detecting the transport of the certified paper in the electromagnetic field, and the light detecting means operates when the certified paper detecting means detects the certified paper. Thus, a distribution of light emission along the transporting direction of the certified paper can be easily obtained by scanning the certified paper by the light detecting means while the transporting means causes the certified paper to cross the environment of the electromagnetic field generated by the electromagnetic field generating means. By transporting the certified paper without moving the light detecting means, scanning can be more easily performed and a scanning construction can be simplified.

Further, since the light detecting means operates when the certified paper detecting means detects the certified paper, it is not necessary to make switching operations to start and stop the light detecting means every time the certified paper is supplied to and discharged from the environment of the electromagnetic field, thereby improving the operability of the apparatus.

The discriminating apparatus may be further provided with the abnormality detecting means for detecting an abnormality of the certified paper being transported and the stopping means for stopping driving of the electromagnetic field generating means upon detection of an abnormality by the abnormality detecting means. Thus, upon detecting an abnormality such as deterioration of the quality of the certified paper in the environment of the electromagnetic field where a high voltage is applied longer than necessary, driving of the electromagnetic field generating means is stopped by the stopping means, thereby preventing an accident resulting from an abnormality from occurring.

BRIEF DESCRIPTION OF THE DRAWINGS

FIGS. 7A and 7B are enlarged sections along C-C of FIG. 6, wherein FIG. 7A shows a state where a usual nonluminescent ink is applied over an electroluminescent ink and FIG. 7B shows a state where printing is made by a mixed ink obtained by mixing the electroluminescent ink with the usual nonluminescent ink, FIGS. 8A, 8B and 8C are graphs changes of output values in proportion to amounts of light detected by a light detecting element during the operation of a light detecting device, wherein FIG. 8A shows a change of the output value over time in the case that the amount of light is outputted as it is without being processed, FIG. 8B shows a change of the output value over time in the case that an analog signal of the amount of detected light is passed through a high-pass filter, and FIG. 8C shows a change of the output value over time in the case that the analog signal of the amount of detected light is passed through a low-pass filter.

Figure 1:
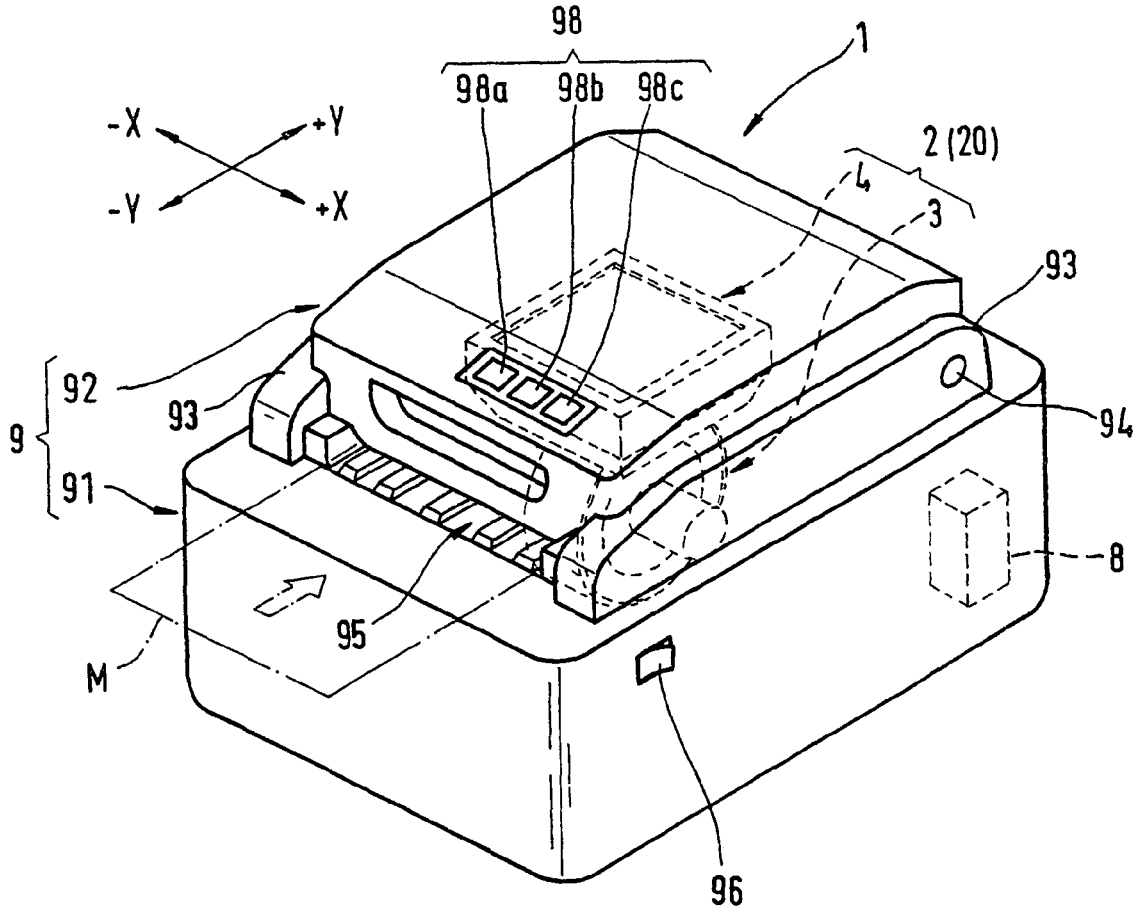
FIG. 1 is a perspective view showing one embodiment of a certified paper discriminating apparatus according to the present invention in a state where a lid of a casing is closed.
Figure 2:
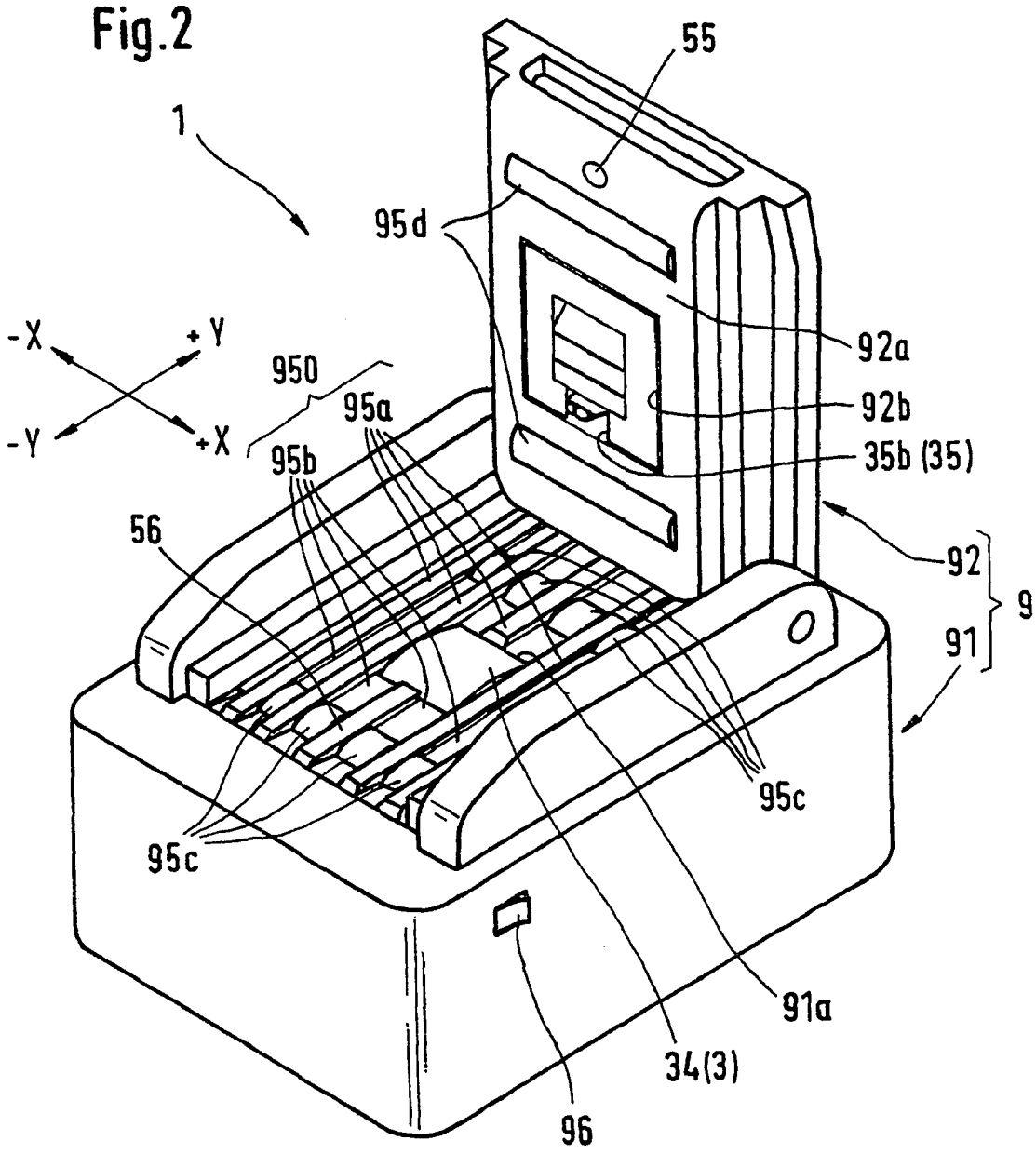
FIG. 2 is a perspective view of the certified paper discriminating apparatus of FIG. 1 in a state where the lid of the casing is open.
Figure 3:
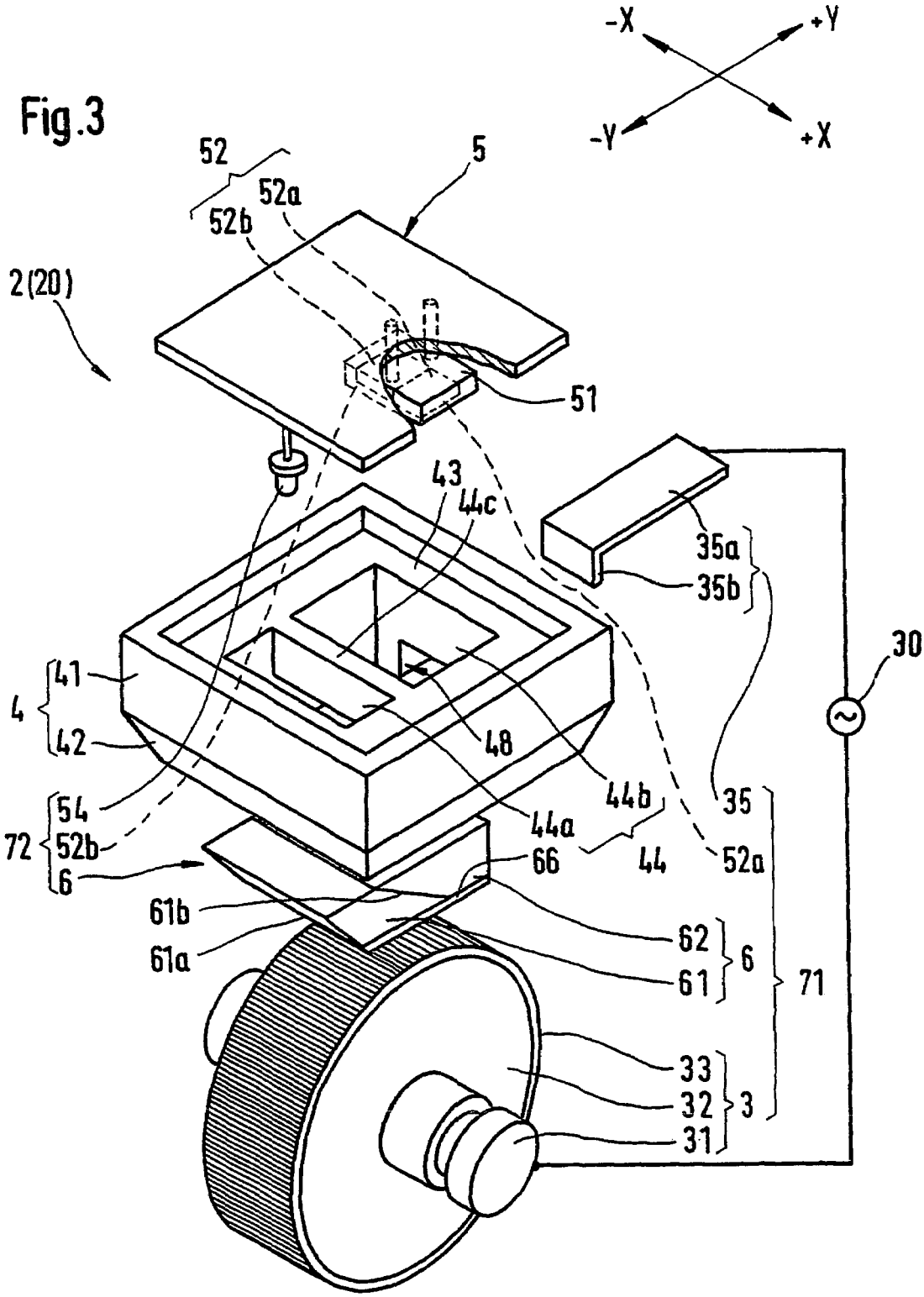
FIG. 3 is an exploded perspective view showing one embodiment of an apparatus main body contained in the casing.
Figure 4:
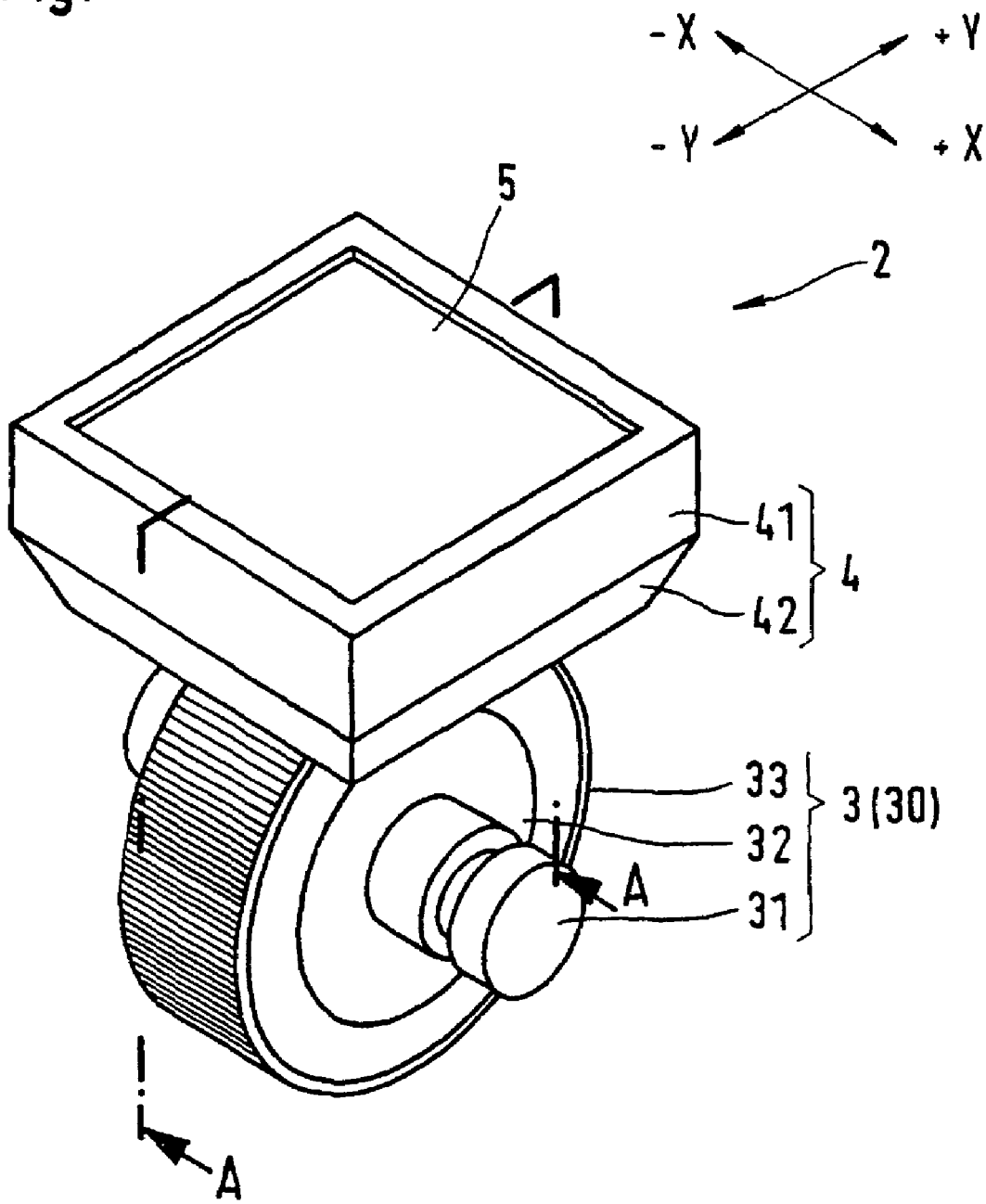
FIG. 4 is a perspective view showing the assembled apparatus main body of FIG. 3.
Figure 5:
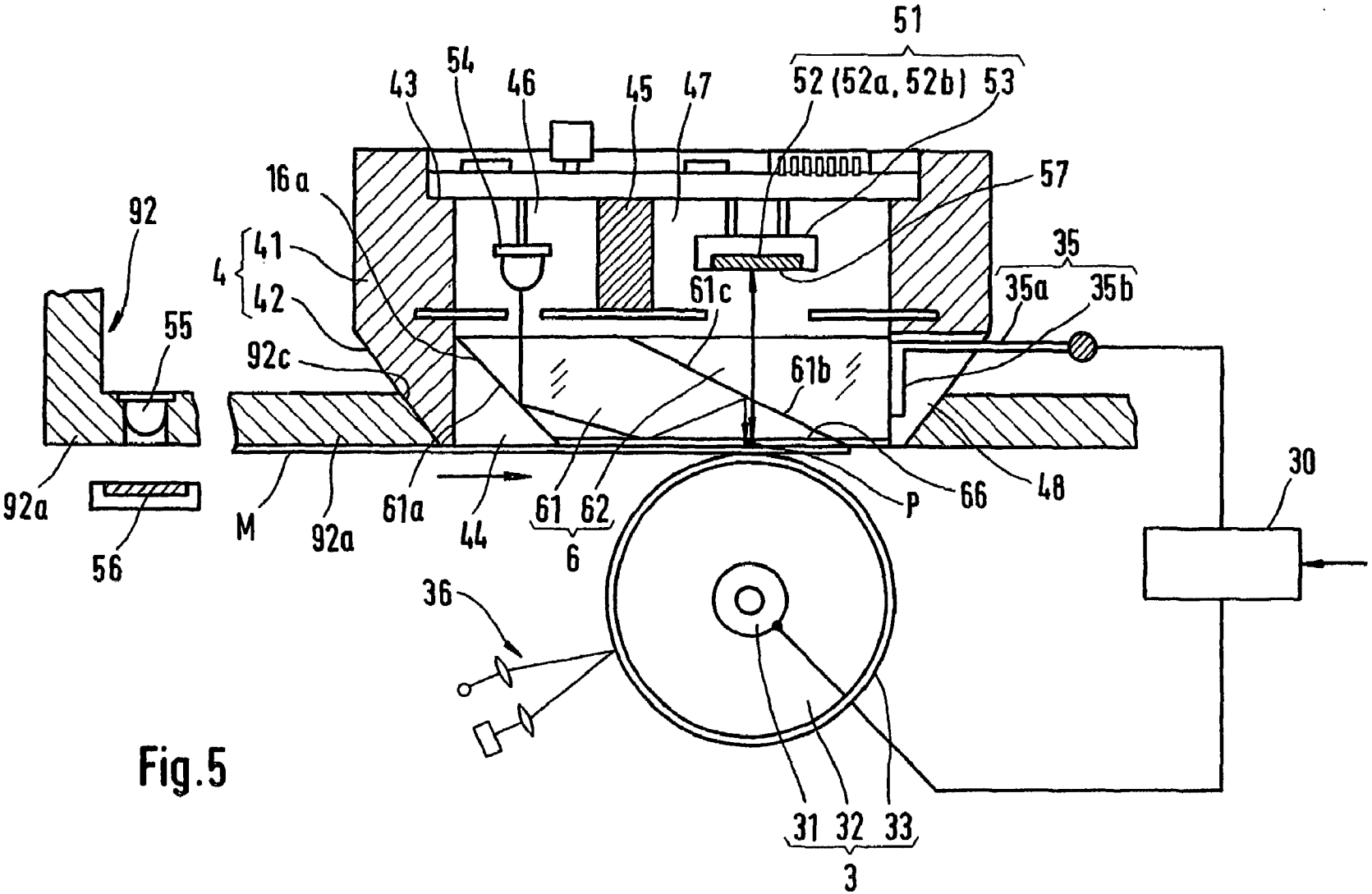
FIG. 5 is a section along A-A of FIG. 4.
Figure 6:
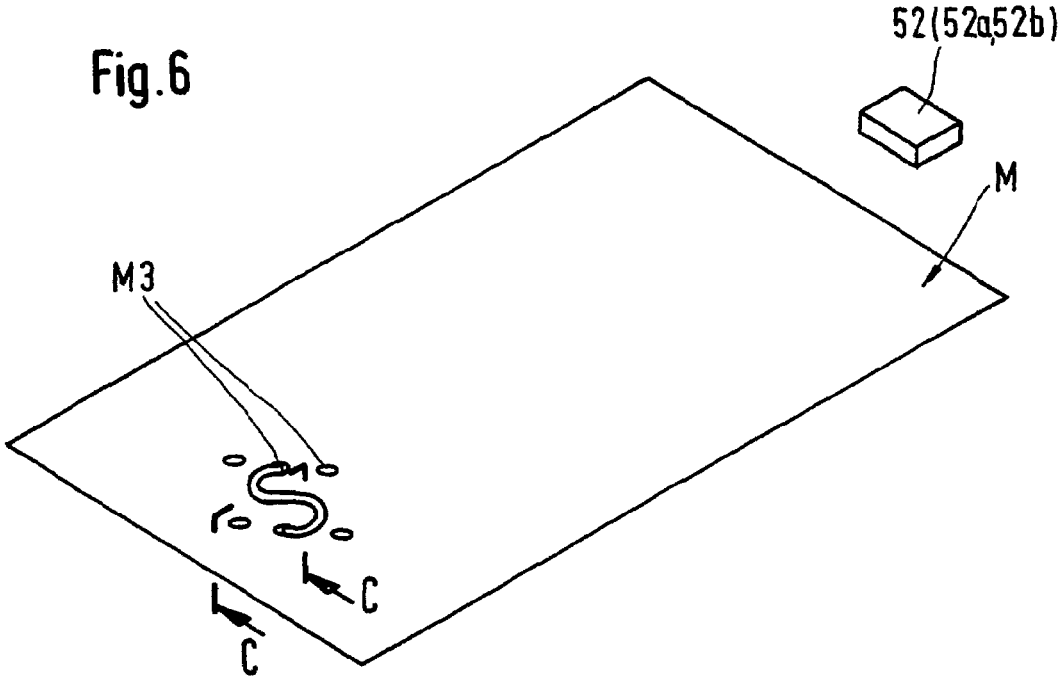
FIG. 6 is a perspective view showing an exemplary printed state of a bank note.
Figure 7A:
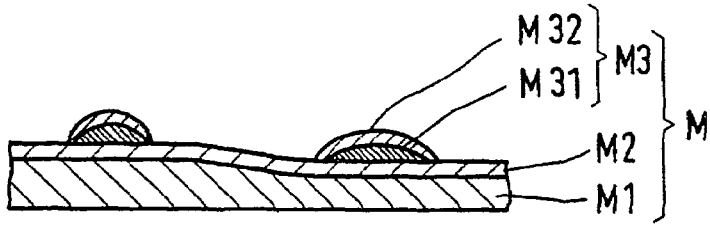
Figure 7B:
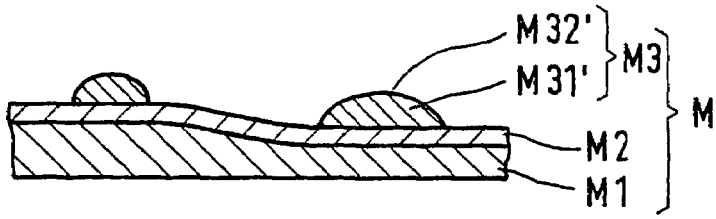
Figure 8A:
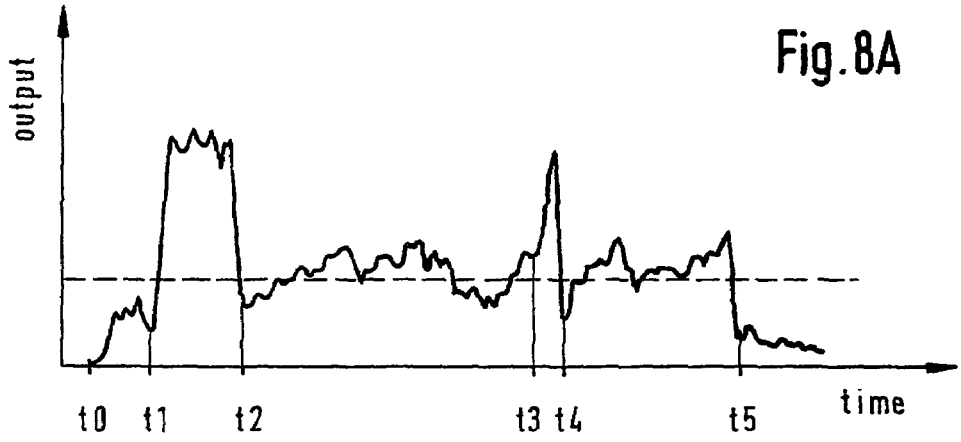
Figure 8B:
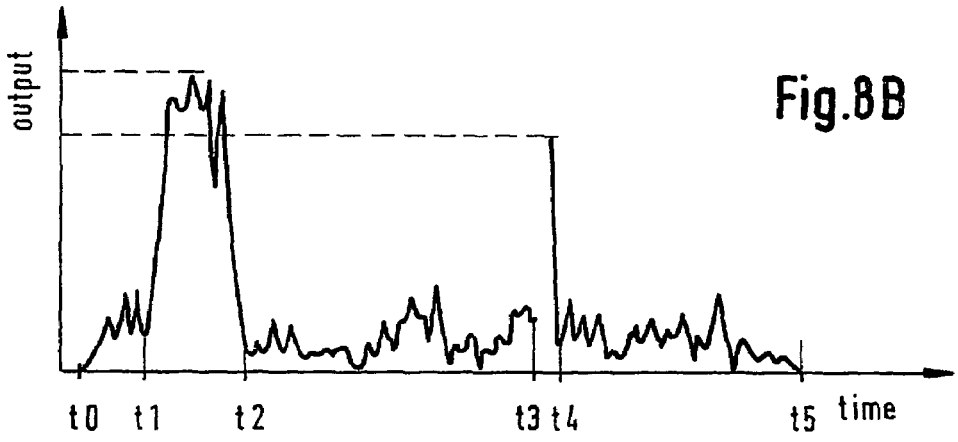
Figure 8C:
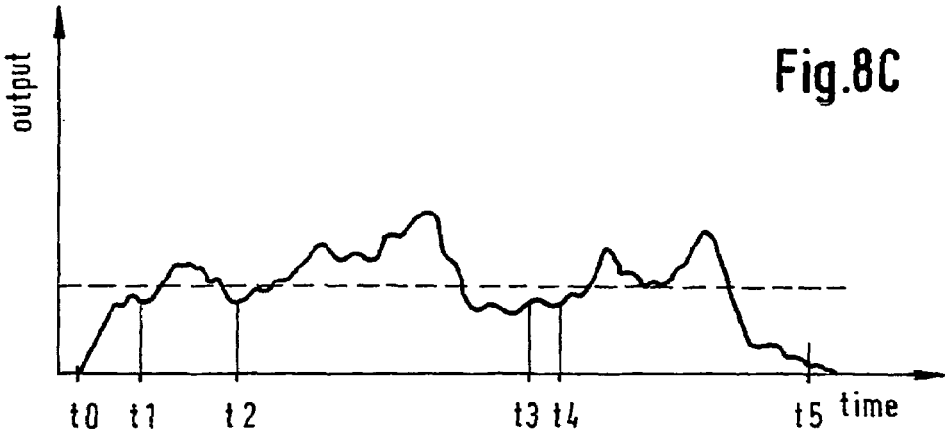
Figure 8D:
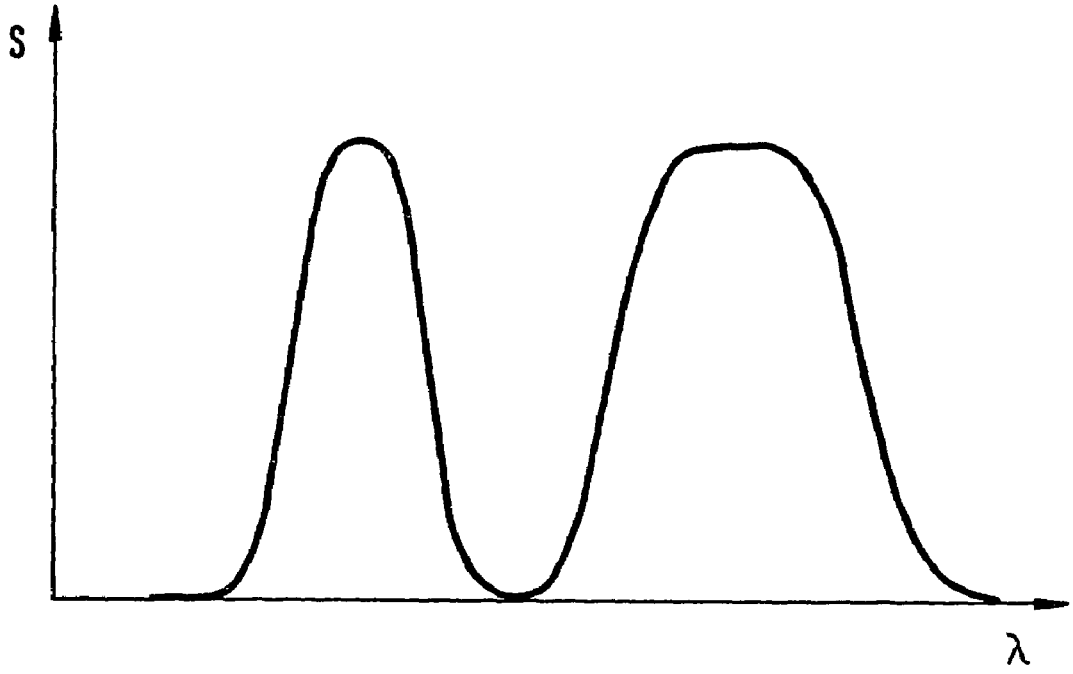
FIG. 8D is a graph showing spectral sensitivity characteristics of first and second light detecting elements.
Figure 9A:
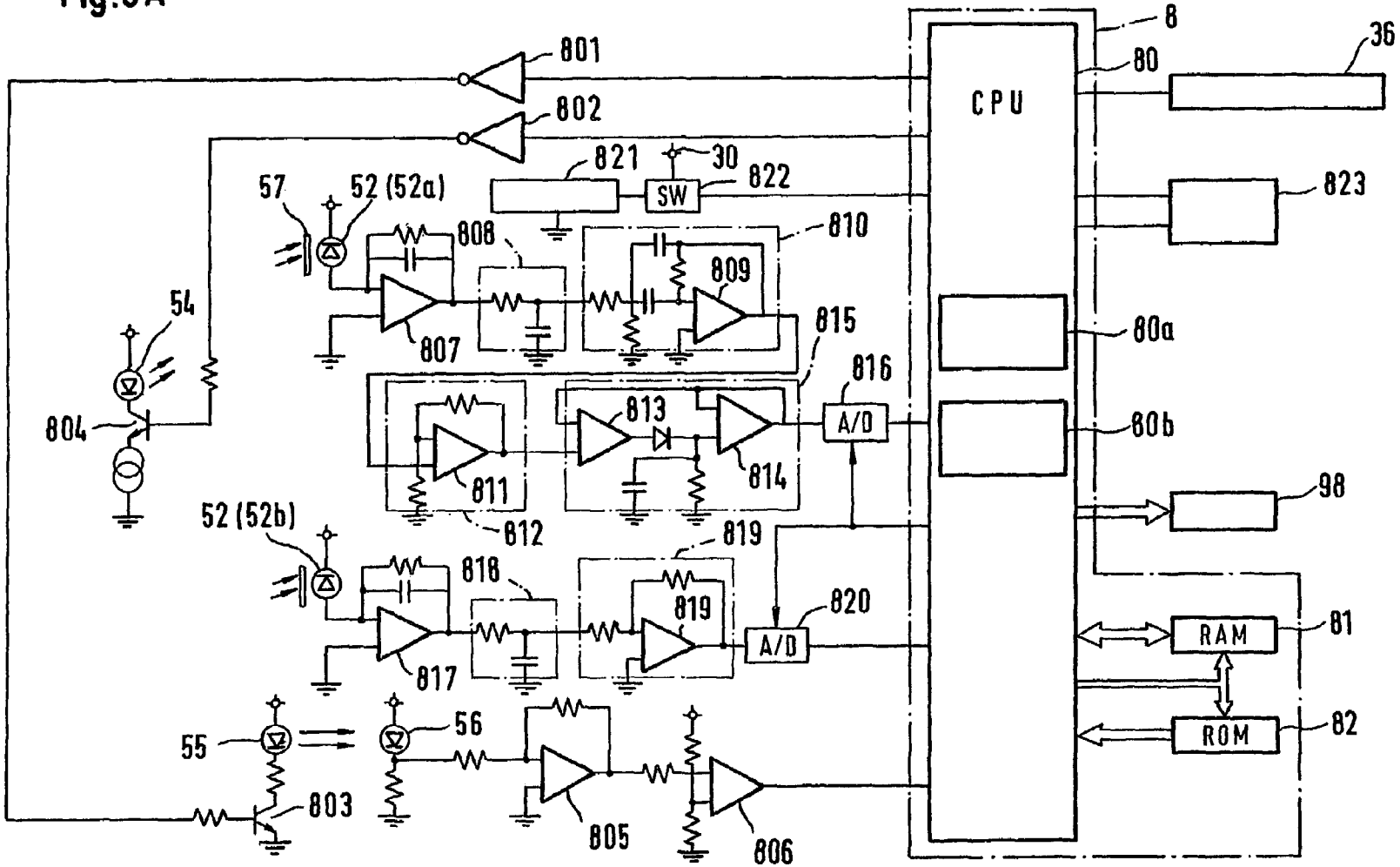
FIG. 9A is a block diagram showing one embodiment of a light detection control by a control unit.
Figure 9B:
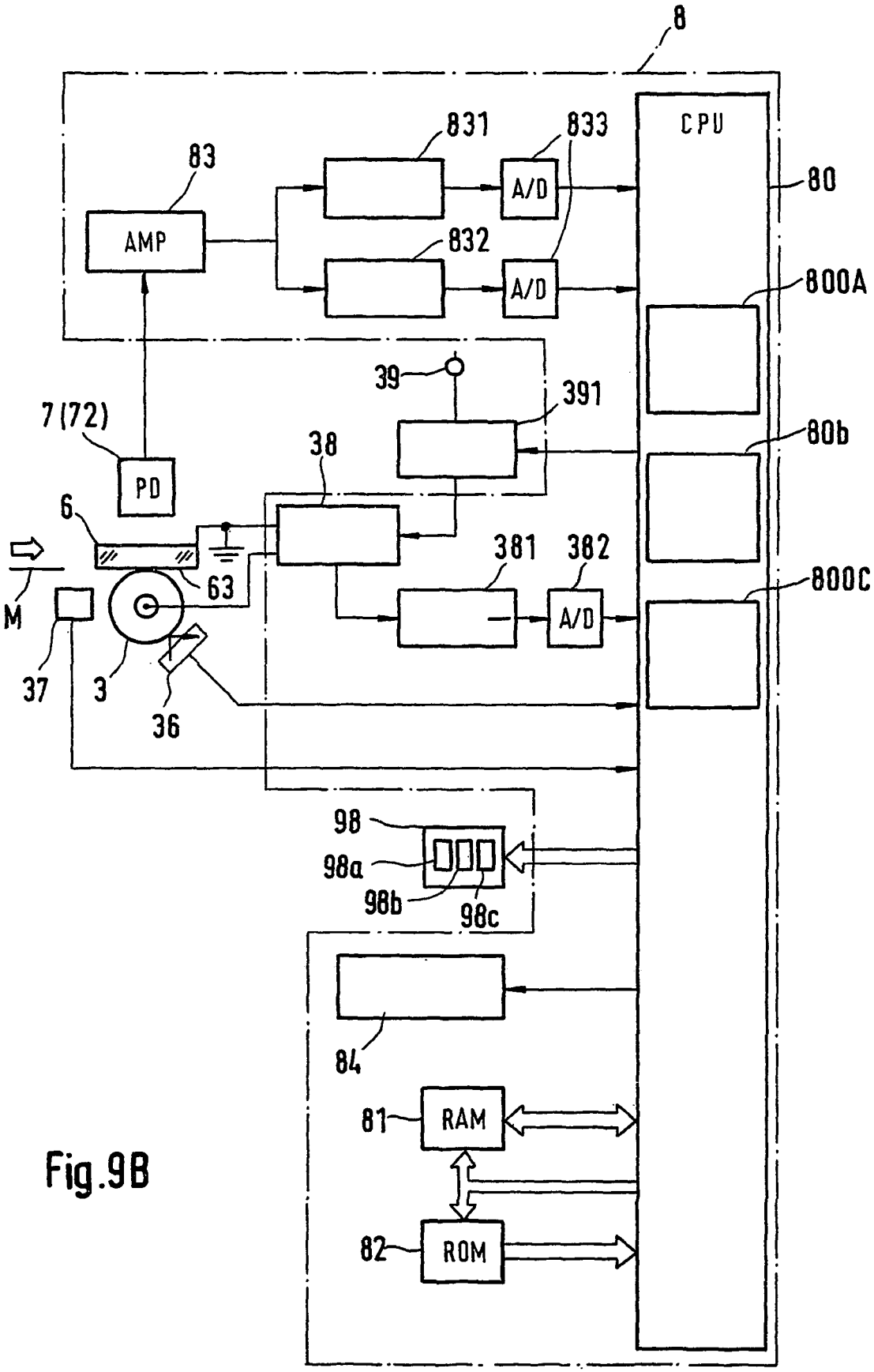
FIG. 9B is an alternative embodiment of the light detection control by a control unit (genuineness discriminating control by the control unit 8 based on the output values of the light detecting element 72), and FIGS. 10A and B are flow charts showing a bank note scanning control routine and a data sampling control routine, respectively.
Figure 10A:
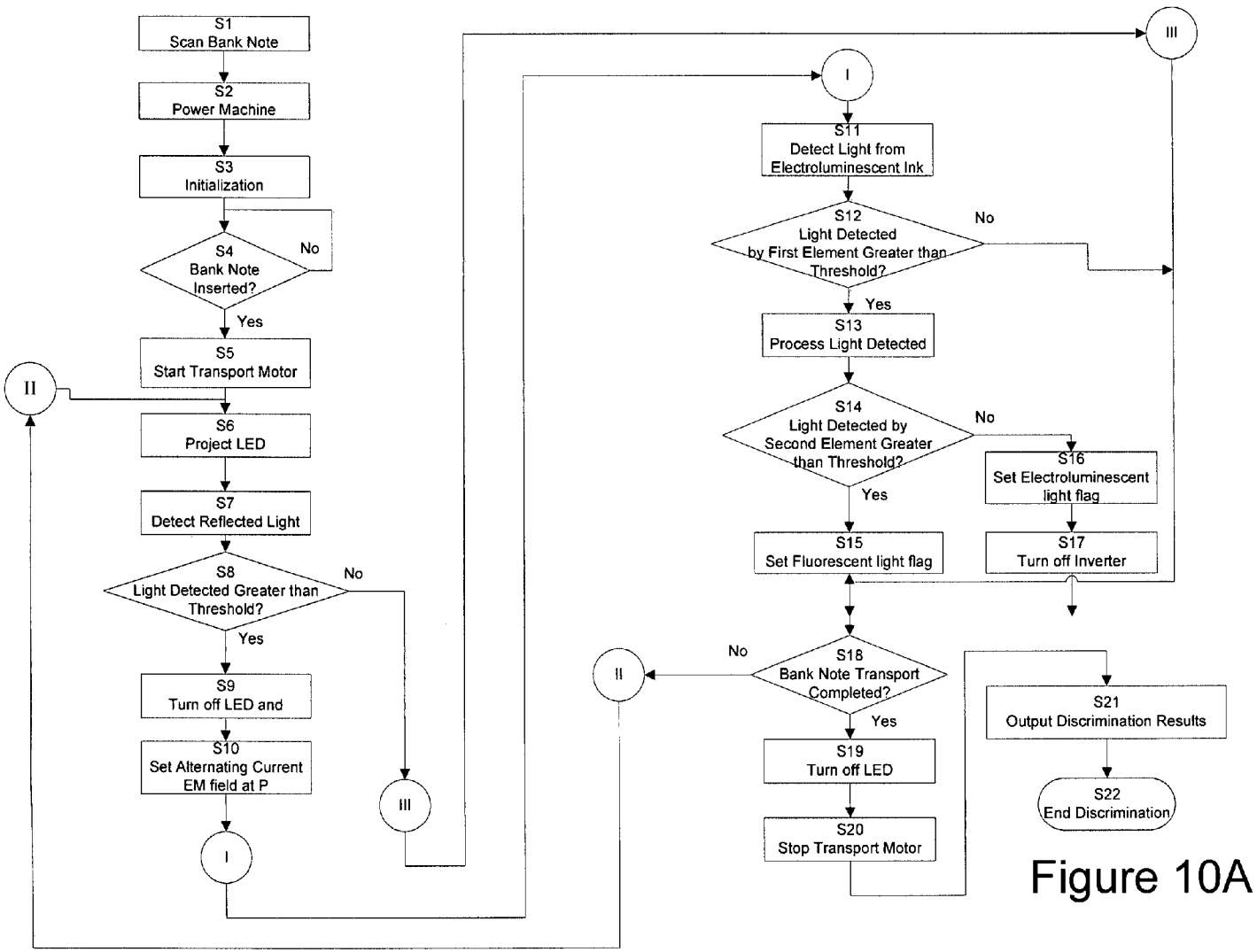
Figure 10B:
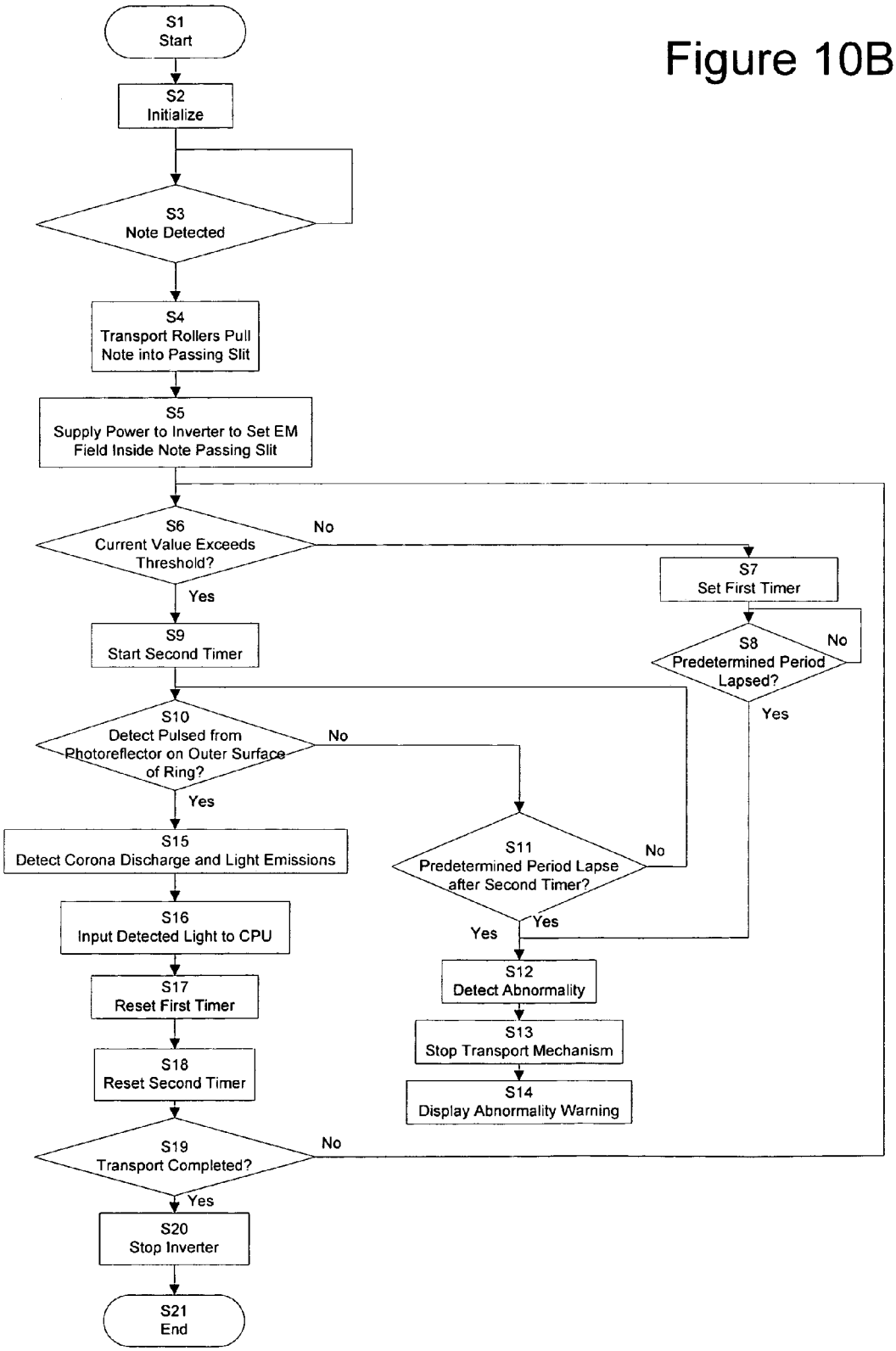
Figure 11:
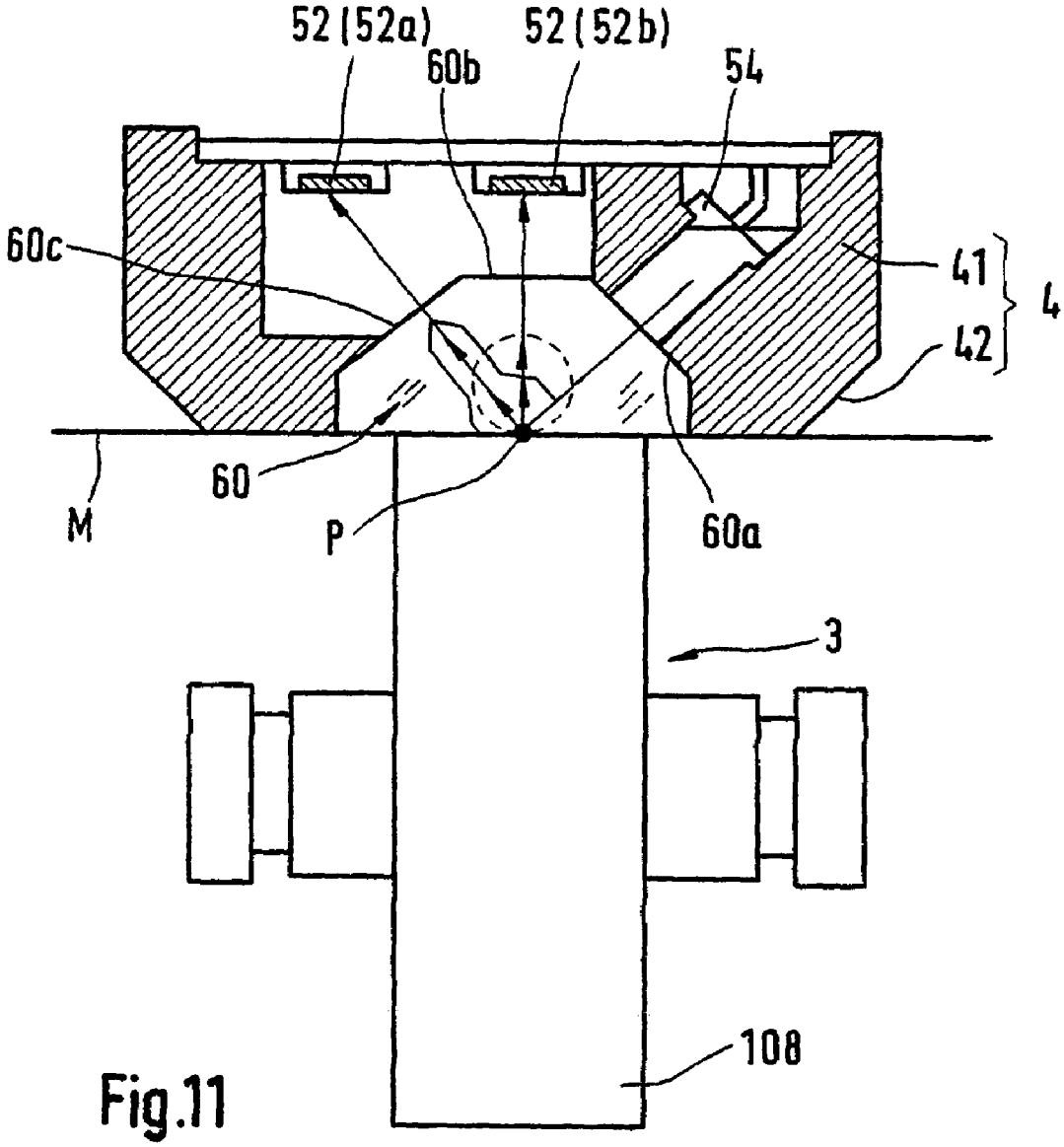
FIG. 11 is a section showing a second embodiment of the sensor construction.
Figure 12:
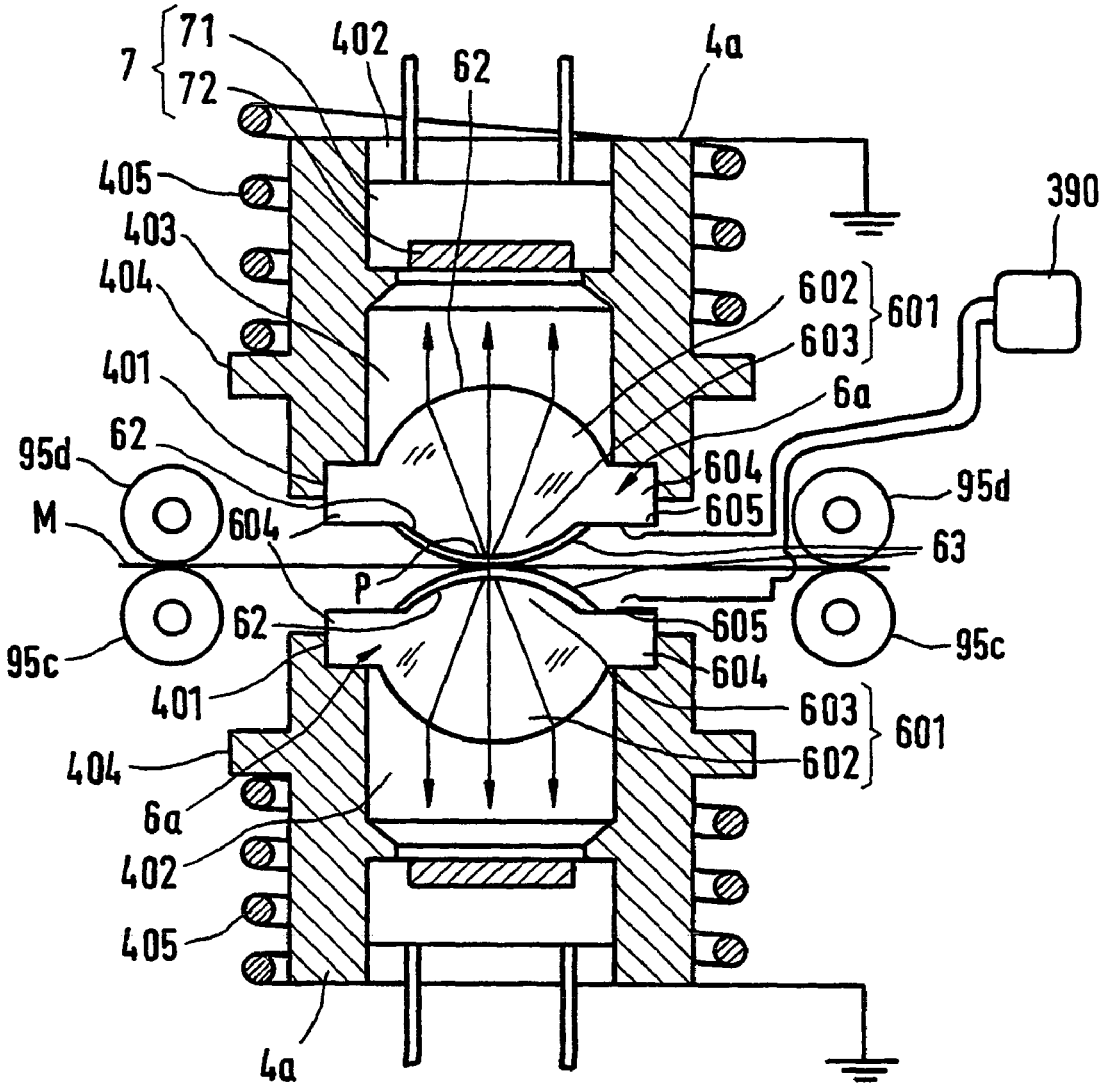
FIG. 12 is a side view in section showing a second embodiment of the sensor construction.
Figure 13:
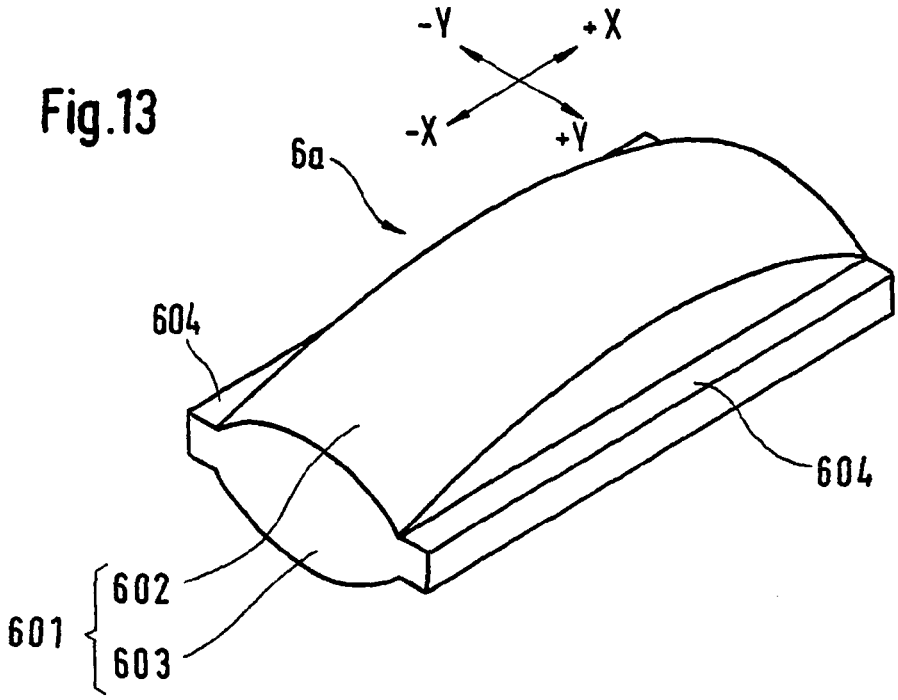
FIG. 13 is a perspective view of one embodiment of the electrode member 6*a*.
Figure 14:
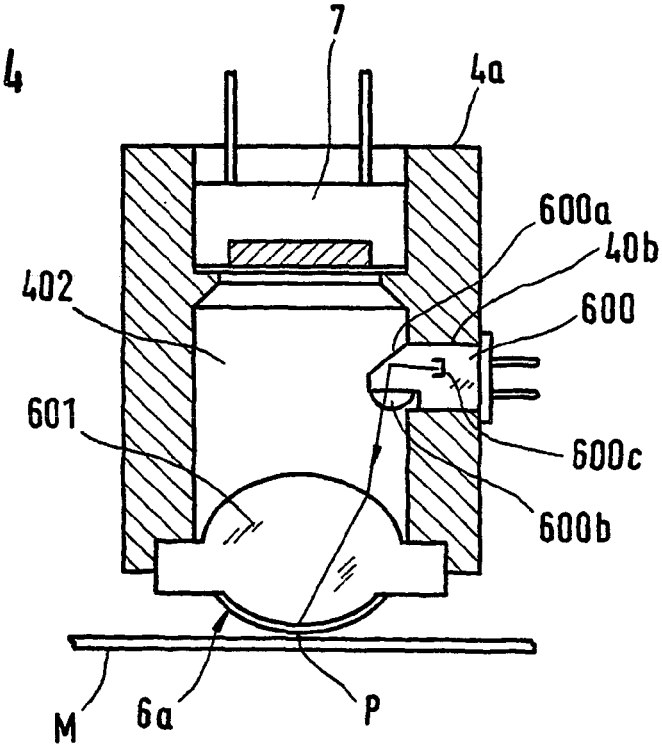
FIG. 14 is a side view in section showing a modified embodiment of the sensor construction of the second embodiment shown in FIG. 12.

The invention claimed is:

1. A method for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: scanning a least a portion of the security mark; exposing a least a portion of the certified paper to a light source emitting the specified wavelength; detecting a first light emitted from the electroluminescent ink of the security mark at a light collecting spot with a first light detecting element configured to produce a first output value waveform corresponding to the intensity of light detected from the electroluminescent ink; detecting a reflected light from the electroluminescent ink of the security mark at a light collecting spot with a second light detecting element configured to produce a first output value waveform corresponding to the intensity of light detected from the non-electroluminescent ink; driving an alternating voltage applying means by an alternating voltage control means to produce an alternating current electromagnetic field; and discriminating the genuineness of the certified paper based on the first and second output value waveform of the fist and second light detecting elements, wherein the alternating voltage control means drives the alternating voltage control applying means only when the at least one of the first light detecting element and second light detecting elements detects the fluorescent from the electroluminescent ink.

2. A method according to claim 1, wherein a control signal to the alternating voltage applying means is output by the alternating voltage control means to set the environment of the alternating-current electromagnetic field at the light collecting spot.

3. A method for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: scanning a least a portion of the security mark; exposing a least a portion of the certified paper to a light source emitting the specified wavelength; detecting a first light emitted from the electroluminescent ink of the security mark at a light collecting spot with a first light detecting element configured to produce a first output value waveform corresponding to the intensity of light detected from the electroluminescent ink; detecting a reflected light from the electroluminescent ink of the security mark at the light collecting spot with a second light detecting element configured to produce a first output value waveform corresponding to the intensity of light detected from the non-electroluminescent ink; driving an alternating voltage applying means to produce an environment of an alternating electric field upon the lapse of a predetermined period after the detection of the certified paper by a detecting sensor; and discriminating the genuineness of the certified paper based on the first and second output value waveform of the fist and second light detecting elements.

4. A method according to claim 3, wherein a control signal to the alternating voltage applying means is output by the alternating voltage control means to set the environment of the alternating-current electromagnetic field at the light collecting spot.

5. A method for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: scanning a least a portion of the security mark; exposing a least a portion of the certified paper to a light source emitting the specified wavelength; detecting a first light emitted from the electroluminescent ink of the security mark at a light collecting spot with a first light detecting means configured to produce a first output value waveform corresponding to the intensity of light detected from the electroluminescent ink; detecting a reflected light from the electroluminescent ink of the security mark at the light collecting spot with a second light detecting means configured to produce a first output value waveform corresponding to the intensity of light detected from the non-electroluminescent ink; splitting the light detected by the light detecting means into a first light from the electroluminescent ink and a second light from the non-electroluminescent ink by an optical splitting means, and discriminating the genuineness of the certified paper based on the first and second output value waveform of the fist and second light detecting means.

6. Method of claim 5, wherein the optical splitting means comprises a first glass substrate and a second glass substrate, the first and second glass substrate having a respective slanted surface set a angles such that the light incident on the first glass substrate is reflected to reach light collect spot.

7. Method of claim 5, wherein the optical splitting means comprises a first glass substrate and a second glass substrate, and positioned such that a light incident on the optical splitting means is reflected to the light detecting means by a semitransparent film positioned between the first and second glass substrate.

8. A method for discriminating the genuineness of a certified paper having at least one security mark including an electroluminescent ink that emits a light upon being exposed to an alternating current electromagnetic field, comprising the steps of:

scanning at least a portion of the security mark;

detecting a light emitted from the electroluminescent ink of the security mark in an environment of an alternating electric field with a light detecting means configured to produce an output value waveform corresponding to the intensity of light detected from the electroluminescent ink;

setting an electric field between two electrode members, each electrode member having a lens portion;

transmitting an emitted light from the certified paper caused by corona discharge through the lens members to the light detecting means; and discriminating the genuineness of the certified paper based on the output value waveform of the light detecting means.

9. A method according to claim 8, wherein the lens portion of the electrode member includes a transparent conductive film and a transparent insulating film.

10. A method for discriminating the genuineness of a certified paper having at least one security mark including a non-electroluminescent ink and an electroluminescent ink that emits a light upon being exposed to an alternating current electromagnetic field, comprising the steps of:

scanning at least a portion of the security mark;

detecting at a first light detecting device a first light emitted by a LED-member and reflected by the certified paper through an electrode member having a lens member to produce a first output value waveform corresponding to the intensity of light detected from the non-electroluminescent ink;

detecting at a second light detecting device a second light emitted from the electroluminescent ink of the certified paper by corona discharge through the lens portion with the electrode member to produce a second output value waveform corresponding to the intensity of the light detected from the electroluminescent ink; and discriminating the genuineness of the certified paper based on the first and second output value waveform of the first and second light detecting means.

11. A method according to claim 10, wherein the lens portion of the electrode member comprises a transparent conductive film and a transparent insulating film.

12. Sensor for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: a light source configured to emit the specified wavelength; a first light detecting element for detecting a first light from the electroluminescent ink of the security mark at a light collecting spot with a first light detecting element configured to produce a first output value waveform corresponding to the intensity of light detected from the electroluminescent ink; a second light detecting element for detecting a reflected light from the electroluminescent ink of the security mark at the light collecting spot with a second light detecting element configured to produce a first output value waveform corresponding to the intensity of light detected from the non-electroluminescent ink; an alternating voltage control means; an alternating voltage applying means configured to drive the alternating voltage control means when the first light detecting means detects the fluorescent light from the electroluminescent ink; and a discriminating element for discriminating the genuineness of the certified paper based on the first and second output value waveform of the fist and second light detecting elements.

13. Sensor unit according to claim 12, wherein a control signal to the alternating voltage applying means is output by the alternating voltage control means to set the environment of the alternating-current electromagnetic field at the light collecting spot.

14. Sensor for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: a light source configured to emit the specified wavelength; a first light detecting element for detecting a first light from the electroluminescent ink of the security mark at a light collecting spot in an environment of an alternating electric field and configured to produce a first output value waveform corresponding to the intensity of light detected from the electroluminescent ink; a second light detecting element for detecting a reflected light from the electroluminescent ink of the security mark at the light collecting spot and configured to produce a second output value waveform corresponding to the intensity of the light detected from the non-electroluminescent ink; an alternating voltage control means; a detector sensor for detecting the certified paper; an alternating voltage applying means drive the alternating voltage control means upon the lapse of a predetermined period after the detection of the certified paper by the detecting sensor; and a discriminating element for discriminating the genuineness of the certified paper based on the first and second output value waveform of the fist and second light detecting elements.

15. Sensor unit according to claim 14, wherein a control signal to the alternating voltage applying means is output by the alternating voltage control means to generate the environment of the alternating-current electromagnetic field at the light collecting spot.

16. Sensor for discriminating the genuineness of a certified paper having at least one security mark including a non-electroluminescent ink and an electroluminescent ink that emits a light being exposed to an alternating current electromagnetic field and emits a fluorescent light being illuminated by a light having a specified wavelength, comprising the steps of: a light source configured to emit the specified wavelength; a first light detecting element for detecting a first light from the electroluminescent ink of the security mark at a light collecting spot with a first light detecting element configured to produce a first output value waveform corresponding to the intensity of light detected from the electroluminescent ink; a second light detecting element for detecting a reflected light from the electroluminescent ink of the security mark at the light collecting spot with a second light detecting element configured to produce a first output value waveform corresponding to the intensity of light detected from the non-electroluminescent ink; an alternating voltage control means; an optical splitting means for splitting the light detected by the light detecting means into a first light from the electroluminescent ink and a second light from the non-electroluminescent ink by an optical splitting means, and a discriminating element for discriminating the genuineness of the certified paper based on the first and second output value waveform of the fist and second light detecting elements.

17. Sensor unit of claim 16, wherein the optical splitting means comprises a first glass substrate and a second glass substrate, the first and second glass substrate having a respective slanted surface set a angles such that the light incident on the first glass substrate is reflected to reach the light collect spot.

18. Sensor unit of claim 17, wherein the optical splitting means comprises a first glass substrate and a second glass substrate and a semitransparent film positioned between the first and second glass substrate such that a light incident on the optically splitting means is reflected by the semitransparent film.

19. Sensor unit for discriminating the genuineness of a certified paper having at least one security mark, the security mark comprising a non-electroluminescent ink and an electroluminescent ink that emits a light upon being exposed to an alternating current electromagnetic field, the sensor comprising:

a light detecting means for detecting a light from the electroluminescent ink of the security mark in an environment of an alternating electric field and configured to produce an output value waveform corresponding to the intensity of light detected from the electroluminescent ink;

two electrode members, each comprising a lens member configured to generate the environment of an alternating electric field and transmit a light emitted from the certified paper caused by corona discharge through the lens members to the light detecting means; and a discriminating element for discriminating the genuineness of the certified paper based on an output value waveform of the light detecting means.

20. Sensor unit according to claim 19, wherein the electrode member comprises a transparent conductive film and a transparent insulating film.

21. Sensor unit for discriminating the genuineness of a certified paper having at least one security mark, the security mark comprising a non-electroluminescent ink and an electroluminescent ink that emits a light upon being exposed to an alternating current electromagnetic field comprising:

a lens member having an electrode member;

a first light detecting means for detecting a first light emitted by a LED-member and reflected by the certified paper through the lens member and configured to produce a first output value waveform corresponding to the intensity of light detected from the electroluminescent ink;

a second light detecting means for detecting a light emitting from the certified paper by corona discharge through the lens member and configured to produce a second output value waveform corresponding to the intensity of the light detected from the non-electroluminescent ink;

a discriminating element for discriminating the genuineness of the certified paper based on the first and second output value waveform of the first and second light detecting means, wherein the first and second light detecting means are configured to detect the emitting lights from the surface of the certified paper.

22. Sensor unit according to claim 21, wherein the electrode member comprises a transparent conductive film and a transparent insulating film.

* * * * *